US012797761B2

(12) United States Patent
Budd et al.

(10) Patent No.: US 12,797,761 B2
(45) Date of Patent: Nov. 17, 2026

(54) TOY SYSTEM

(71) Applicant: MOOSE CREATIVE MANAGEMENT PTY LIMITED, Cheltenham (AU)

(72) Inventors: Carl Wain Budd, Patterson Lakes (AU); Toby John Jarrett, Dingley Village (AU); Wesley Thomas, Brighton (AU); Brandon Cole Sopinsky, Los Angeles, CA (US)

(73) Assignee: Moose Creative Management Pty Limited, Cheltenham (AU)

( * ) Notice: Subject to any disclaimer, the term of this patent is extended or adjusted under 35 U.S.C. 154(b) by 358 days.

(21) Appl. No.: 18/590,420

(22) Filed: Feb. 28, 2024

(65) Prior Publication Data

US 2025/0269293 A1 Aug. 28, 2025

(51) Int. Cl.

| | |
|---|---|
| ***A63H 3/50*** | (2006.01) |
| ***A63H 9/00*** | (2006.01) |
| ***A63H 33/22*** | (2006.01) |
| ***A63J 21/00*** | (2006.01) |

(52) U.S. Cl.

CPC ..... *A63H 9/00* (2013.01); *A63H 3/50* (2013.01); *A63H 33/22* (2013.01); *A63J 21/00* (2013.01)

(58) Field of Classification Search

CPC ..... A63H 3/50; A63H 3/52; A63H 9/00; A63H 33/00; A63H 33/22; A63F 2009/0012; A63F 2009/0013; A63F 2009/0053; B65D 11/02; B65D 11/04; B65D 11/06; A63J 21/00

USPC ..... 446/73–75, 236, 267; 472/57, 71

See application file for complete search history.

(56) References Cited

U.S. PATENT DOCUMENTS

| | | | | | |
|---|---|---|---|---|---|
| 1,692,938 | A * | 11/1928 | Jacobs | A63H 33/3022 | 472/57 |
| 2,441,607 | A * | 5/1948 | Walls | A63H 33/22 | 40/493 |
| 2,580,305 | A * | 12/1951 | Kremer | B44F 1/10 | 472/71 |
| 2,648,157 | A * | 8/1953 | Wilson | A63H 33/26 | 472/67 |

(Continued)

FOREIGN PATENT DOCUMENTS

| | | | | |
|---|---|---|---|---|
| JP | 61 4698 | | 1/1986 | |
| JP | 7397579 | B2 * | 12/2023 | A63H 23/08 |

OTHER PUBLICATIONS

International Search Report and Written Opinion in International Application No. PCT/US2024/060986, mailed on Apr. 4, 2025, in 17 pages.

*Primary Examiner* — Alexander R Niconovich

(74) *Attorney, Agent, or Firm* — Knobbe, Martens, Olson & Bear, LLP

(57) ABSTRACT

An interactive toy system includes a barrel having an internal space configured to hold a toy and a bottle. The bottle can have an outer circumference forming an enclosure to house at least a portion of the barrel therein. A portion of the outer circumference can include a chamber configured to hold a transparency changing liquid. The chamber can have an inner wall and an outer wall offset from the inner wall. In some implementations, the toy system includes a handle configured to rotate the barrel between at least a first position and a second position relative to the bottle.

20 Claims, 30 Drawing Sheets

(56) References Cited

U.S. PATENT DOCUMENTS 3,250,531 A * 5/1966 Convertine ..... A63H 33/3022 446/479
3,488,880 A * 1/1970 Taylor ..... A63H 33/22 40/493
3,842,531 A * 10/1974 Sloan ..... A63H 3/52 40/406
4,026,066 A * 5/1977 Reiner ..... A63H 33/22 446/236
4,204,363 A * 5/1980 Knott ..... A63H 17/10 446/76
5,236,384 A * 8/1993 Fabricant ..... A63H 3/36 273/291
5,261,848 A * 11/1993 Kaplan ..... G09F 19/08 40/410
5,702,282 A * 12/1997 Beckman ..... A63H 3/52 472/72
5,779,552 A * 7/1998 Gelfond ..... A63J 21/00 472/67
7,527,542 B2 * 5/2009 Collins ..... A63F 7/045 40/406
7,607,962 B2 * 10/2009 Hardin ..... A63H 15/00 446/175
8,257,188 B2 * 9/2012 Monshouwer ..... A63J 21/00 472/81
10,046,883 B1 * 8/2018 Lui ..... A63H 3/50
11,607,621 B2 * 3/2023 O'Brien ..... A63H 3/00
11,786,834 B2 * 10/2023 Del Giudice ..... A63H 3/50 446/73
12,090,418 B1 * 9/2024 Lindberg ..... A63H 3/005
12,383,840 B2 * 8/2025 Martin ..... A63H 3/005
12,458,900 B2 * 11/2025 Tankel ..... A63H 3/50
2021/0228994 A1 7/2021 O'Brien et al.
2022/0118373 A1 4/2022 Del Giudice et al.
2024/0075397 A1 3/2024 Tankel et al.

* cited by examiner

1000

TOY SYSTEM

TECHNICAL FIELD

A toy system is described. More specifically, embodiments of the toy system provide an interactive experience for a user to reveal a figurine.

BACKGROUND

Miniature figurines, dolls, stuffed toys, or plush toys have proven to be popular and long-lasting toy products. Nevertheless, there remains a continuing need for providing more interactive and amusing toys to enhance a user's experience.

SUMMARY

The present disclosure is directed to a toy system that includes at least a bottle and a barrel. It should be noted that the bottle and/or the barrel is not limited to the illustrated shape or size and can have any other shapes or sizes and still fall within the scope of this disclosure. In certain embodiments, a liquid contained in a chamber of the bottle changes from an opaque color to a transparent color in response to an operation on the toy system such that a user may identify an identity of a figurine that is contained in the barrel.

In some aspects, the techniques described herein relate to a toy system having an internal space for housing a toy, comprising: a bottle having a front portion forming a chamber, the chamber being configured to be filled with a liquid; and a barrel rotatably disposed in the bottle so as to rotate from a first position to a second position, the barrel being sized and shaped to at least partially surround the toy in the internal space, wherein when the barrel is in the first position the internal space is not visible from outside the bottle, and wherein when the barrel is in the second position the internal space is visible from outside the bottle.

In some aspects, the techniques described herein relate to a toy system, further comprising a handle configured to allow a user to rotate the barrel.

In some aspects, the techniques described herein relate to a toy system, further comprising the toy disposed in the internal space, the toy being accessible when the barrel is removed from the bottle.

In some aspects, the techniques described herein relate to a toy system, wherein the chamber comprises two concentric walls, and wherein the two concentric walls extend for less than 360 degrees about a circumference of the bottle.

In some aspects, the techniques described herein relate to a toy system, further comprising a capsule containing an ingredient configured to mix with the liquid.

In some aspects, the techniques described herein relate to a toy system, wherein the capsule is disposed in the bottle and above the barrel.

In some aspects, the techniques described herein relate to a toy system, wherein the ingredient is configured to change a transparency of the liquid.

In some aspects, the techniques described herein relate to a toy system, wherein the ingredient is configured to create fizz in the liquid.

In some aspects, the techniques described herein relate to a toy system, further comprising a lid having a button, wherein activation of the button is configured to release the ingredient into the liquid.

In some aspects, the techniques described herein relate to a toy system having an internal space for housing a toy, comprising: a bottle having a front portion forming a chamber, the chamber being configured to be filled with a liquid; and a barrel disposed in the bottle and having an opaque portion and a window, the barrel being rotatable relative to the bottle from a first position to a second position, wherein the opaque portion of the barrel overlaps the chamber of the bottle when the barrel is in the first position so that a view of the toy in the internal space from outside the bottle is obfuscated, and wherein the window of the barrel overlaps the chamber of the bottle when the barrel is in the second position so that the toy is visible from outside the bottle.

In some aspects, the techniques described herein relate to a toy system, wherein the chamber comprises two concentric walls, and wherein the two concentric walls extend for less than 360 degrees about a circumference of the bottle.

In some aspects, the techniques described herein relate to a toy system, further comprising a capsule containing an ingredient configured to mix with the liquid.

In some aspects, the techniques described herein relate to a toy system, wherein the ingredient is configured to change a transparency of the liquid.

In some aspects, the techniques described herein relate to a toy system comprising: a barrel having an internal space configured to hold a toy; a bottle having an outer circumference forming an enclosure to house at least a portion of the barrel therein, a portion of the outer circumference comprising a chamber configured to hold a liquid, the chamber having an inner wall and an outer wall offset from the inner wall; and a handle configured to rotate the barrel between at least a first position and a second position relative to the bottle.

In some aspects, the techniques described herein relate to a toy system, further comprising a capsule configured to hold an ingredient, wherein actuation of a button releases the ingredient into the chamber.

In some aspects, the techniques described herein relate to a toy system, wherein the ingredient is a clarifying agent configured to change a transparency of the liquid.

In some aspects, the techniques described herein relate to a toy system, wherein the ingredient is configured to create fizz in the liquid.

In some aspects, the techniques described herein relate to a toy system, wherein the inner wall and the outer wall are transparent, and wherein a remainder of the outer circumference of the bottle is opaque.

In some aspects, the techniques described herein relate to a toy system, wherein the barrel comprises an opaque portion and a window portion, and wherein the opaque portion of the barrel overlaps with the inner wall and the outer wall when the barrel is in the first position, and wherein the window portion of the barrel overlaps with the inner wall and the outer wall when the barrel is in the second position.

In some aspects, the techniques described herein relate to a toy system, wherein the liquid is initially opaque.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

Figure 1A:
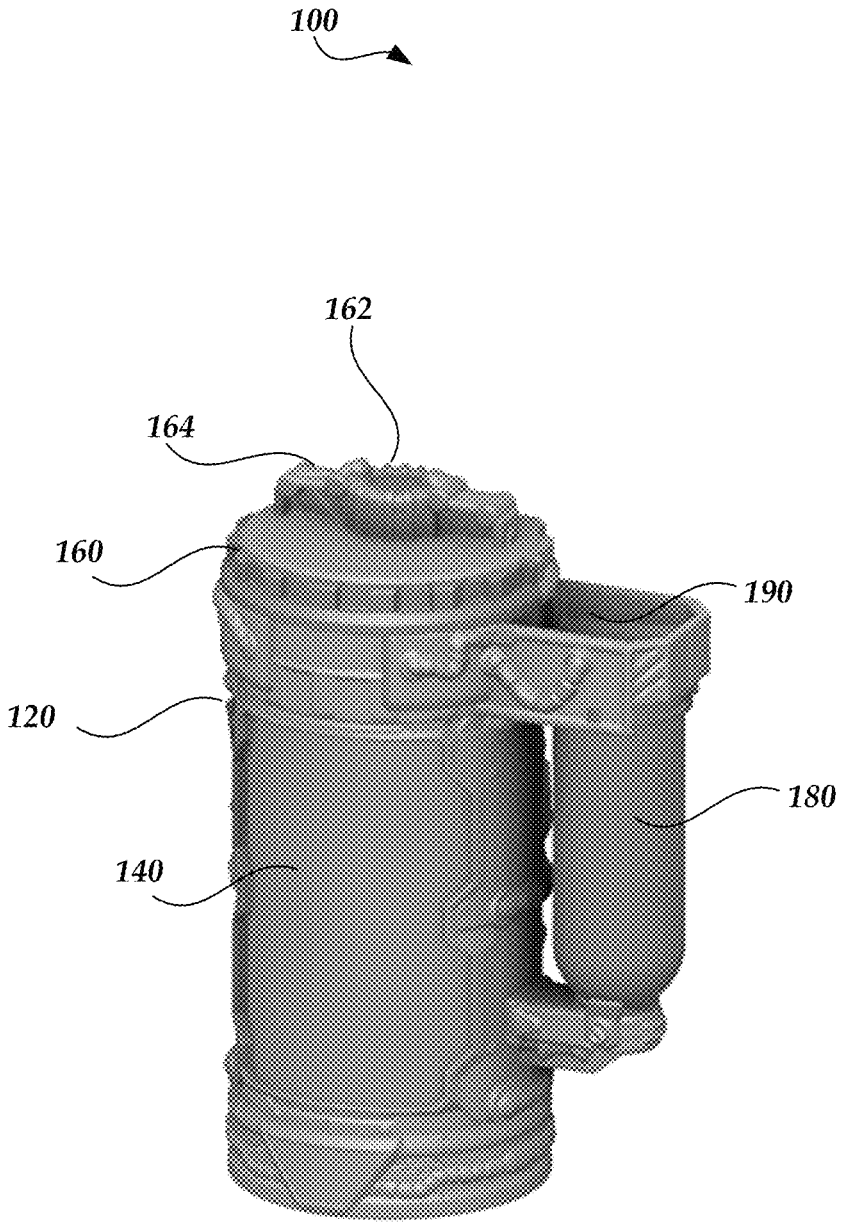
FIG. 1A shows a picture of a toy system in accordance with some embodiments of the present disclosure.

The present description will be directed in particular to elements forming part of, or cooperating more directly with, apparatus and methods in accordance with the present invention. It is to be understood that elements not specifically shown or described may take various forms well known to those skilled in the art.

Embodiments of the toy system disclosed herein, provides a user or a group of users an experience of revealing a toy, such as a figurine that is housed in an internal space (e.g., a rotating barrel, or an inner chamber) of the toy system. For example, before a user interacts with the toy system, the figurine's appearance/identity is unknown to the user. This increases the user's curiosity and anticipation. After one or more actions of playing with the toy system, including, for example, pouring liquid into a tank of the toy system, actuating a handle (e.g., rotating and/or pressing) for releasing a clarifying agent or ingredient from a capsule into the tank to change a color of the liquid, the figurine's appearance/identity is gradually revealed to the user. The capsule can be disposed in the bottle and above the barrel. Pressing of the handle or button can cause spikes to puncture the capsule. The ingredient changes a transparency of the liquid. In certain embodiments, the ingredient is configured to create fizz in the liquid. The user can then open the toy system to access the figurine. The actions make the unboxing and toy revealing process more enjoyable and exciting.

In some embodiments, the figurine may be fully or partially surrounded by a rotating barrel that is contained in a bottle of the toy system. A portion of the rotating barrel may be opaque or non-transparent to block a user from viewing the figurine through the portion. Another portion of the rotating barrel can be open or form a window in the barrel. Depending on the rotational position or clocking of the barrel and on the clarity of liquid in the dye container, the user may or may not be able to view the figurine.

In certain embodiments, the bottle may include a front portion (e.g., an inner space of the bottle, such as a dye container, or a tank) that appears transparent to a user under certain conditions. A remaining portion(s) of the bottle may be opaque or non-transparent to the user. As such, a user may view into the bottle through the front portion under certain conditions, but may not view into the bottle to see content within the bottle (e.g., the barrel and the figurine) through the remaining portion(s) of the bottle.

In some embodiments, the front portion of the bottle may be formed mainly by two walls. The front portion (e.g., a dye container that can hold fluid or liquid) may have various thicknesses. The two walls that form the front portion may be transparent. As such, when the front portion does not contain opaque liquid, a user may view into the bottle through the front portion. However, a user may not view into the bottle through the remaining portions of the bottle because the remaining portions are non-transparent.

In some embodiments, the toy system may include a tube that contains fluid (e.g., the liquid). The tube may be detachably connected to the toy system. A user may remove the tube from the toy system and pour the liquid into the front portion of the bottle. The liquid may be opaque or dark in color. After pouring the liquid into the front portion, the user may not view the content (e.g., the rotating barrel) housed inside the bottle through the front portion because the liquid occupies the front portion of the bottle.

In some embodiments, the toy system includes a bottle lid that is detachably connected to the bottle. After pouring the liquid into the front portion of the bottle, a user may actuate (e.g., rotate) a handle of the bottle lid to expose a button on the bottle lid. In some embodiments, actuating the handle of the bottle lid further moves a position of the rotating barrel and the figurine. For example, as the user rotates the handle by a particular degree (e.g., 180°), the rotating barrel and the figurine switches from a first position to a second position. More specifically, a front of the figurine may face the front portion of the bottle (e.g., dye container) after the user rotates the handle.

In some embodiments, the user may interact with (e.g., press) the button of the bottle lid to release a clarifying agent or ingredient from the capsule into the front portion of the bottle. The clarifying agent may cause the liquid inside the front portion to change within a particular amount of time from its original opaque or dark color to a color (e.g., transparent) that permits the user to look through the front portion into the bottle. After the liquid changes to the color or becomes transparent, the user may see the figurine and identify the identity of the figurine. The capsule can be disposed in the bottle and above the barrel. Pressing of the handle or button can cause spikes to puncture the capsule. The ingredient changes a transparency of the liquid. In certain embodiments, the ingredient is configured to create fizz in the liquid.

The user may manipulate (e.g., unscrew or rotate) the bottle lid to remove the bottle lid from the bottle. After removing the bottle lid from the bottle, the user may retrieve the figurine from the rotating barrel within the bottle. In some embodiments, the figurine may be partially enclosed or fully enclosed by the rotating barrel and the rotating barrel may be contained within the bottle of the toy system. A top portion of the rotating barrel may be connected to a bottom portion of the bottle lid. As such, when a user rotates the handle of the bottle lid, the rotating barrel may be rotated as well, thereby causing the figurine within the rotating barrel to change from rear facing to front facing the front portion of the bottle and causing an opaque portion (e.g., window) of the rotating barrel to align with the front portion of the bottle.

Advantageously, embodiments of the toy system disclosed herein therefore provide a user (or player) or a group of users an interactive and satisfying play experience, such as by providing prolonged comic relief, attraction, and surprise (e.g., gradual reveal of the figurine because of the color change of a liquid) to the user. By employing a relatively small front portion, little liquid is needed for the play experience.

Although the various aspects will be described in accordance with illustrative embodiments and combination of features, one skilled in the relevant art will appreciate that the examples and combination of features are illustrative in nature and should not be construed as limiting. More specifically, aspects of the present application may be applicable with various types of toys, such as figurine of various resemblances, plush toys, dolls and the like. Still further, although a specific structure and assembly of a toy system for enhancing user experience will be described, such illustrative toy system design or structure should not be construed as limiting. Accordingly, one skilled in the relevant art will appreciate that the aspects of the present application are not necessarily limited to application to any particular type of toys, or figurines.

FIG. 1A illustrates a picture of a toy system 100 in accordance with some embodiments of the present disclosure. As shown in FIG. 1A, the toy system 100 includes a bottle 120, a bottle lid 160, a tube 180, and a figurine (e.g. a figurine shown in FIG. 10) that can be contained within the bottle 120. The bottle 120 may include at least a front portion 140 and a first portion 190. The bottle lid 160 may include a lock 162 and a handle 164.

In some embodiments, the front portion 140 may be an inner space that can hold liquid within the bottle 120. For example, the front portion 140 may be a dye container or a tank that can receive and store liquid. The front portion 140 or tank may be formed mainly by two walls that are separated by a certain distance. The front portion 140 may be fluidically connected to the first portion 190. As such, liquid poured into the first portion 190 may flow and be contained in the front portion 140. Although not readily observed in FIG. 1A, the two walls that form the front portion 140 may be transparent. As such, when the front portion 140 does not contain opaque liquid, a user may see into the bottle 120 through the front portion 140. The remainder of the bottle 120 is not transparent.

Figure 1B:
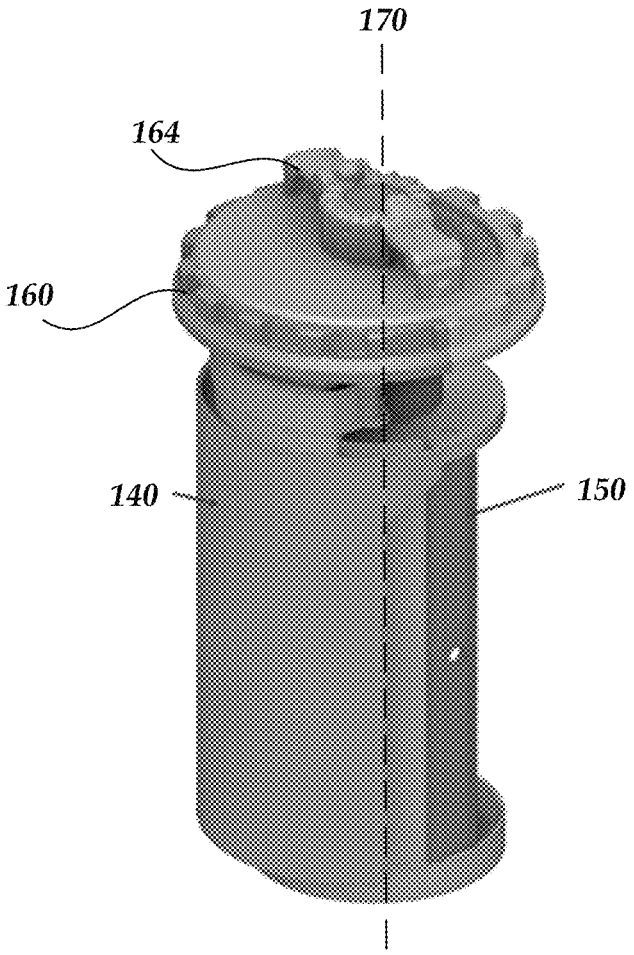
FIG. 1B shows a portion of the toy system of FIG. 1A in accordance with some embodiments of the present disclosure.

FIG. 1B illustrates a portion of the toy system 100 in accordance with some embodiments of the present disclosure. More specifically, FIG. 1B shows the front portion 140 of the bottle 120 with the remaining portions of the bottle 120 removed for clarity (e.g., the first portion 190, portions of the bottle 120 that are adjacent to the front portion 140). In some embodiments, the front portion 140 of the bottle 120 may be affixed or attached during manufacturing to the remaining portions of the bottle 120. As shown in FIG. 1B, the toy system 100 includes a rotating barrel 150 that is contained within the bottle 120. The rotating barrel 150 may fully or partially enclose a figurine (e.g. the figurine shown in FIG. 10).

In some embodiments, although not illustrated in FIG. 1B, the rotating barrel 150 may partially surround the figurine. In these embodiments, at least a portion of the rotating barrel 150 may be opaque (e.g., covered by a sticker). As such, the user may not view the figurine through the portion of the rotating barrel 150 that is opaque. However, the user may view the figurine through the open portion or window in the rotating barrel 150 if the open portion or window is rotated so as to align with the front portion 140 of the bottle 120 and the liquid in the front portion 140 is transparent.

In other embodiments, the rotating barrel 150 may fully surround the figurine. In these embodiments, a portion of the rotating barrel 150 may be opaque and a remaining portion of the rotating barrel 150 may be transparent. As such, a user may not view the figurine through the portion of the rotating barrel 150 that is opaque but may view the figurine through the remaining portion of the rotating barrel 150 that is transparent under certain conditions.

In some embodiments, the rotating barrel 150 may change its position or rotate around axis 170 when the handle 164 is rotated. This rotation causes the open portion or window in the rotating barrel 150 to align with the front portion 140 of the bottle 120. For example, before the handle 164 is rotated, an opaque portion of the rotating barrel 150 is located between the front portion 140 of the bottle 120 and the figurine. As such, the user only sees the opaque portion of the rotating barrel 150 through the front portion 140 of the bottle 120.

After the handle 164 is rotated by a certain degree (e.g., 180°) causing the open portion or window in the rotating barrel 150 to align with the front portion 140 of the bottle 120, the user still can not see inside the rotating barrel 150 if the liquid in the front portion 140 of the bottle 120 is opaque. Not until the liquid in the front portion 140 is clarified will the user be able to see the figurine inside the rotating barrel 150.

Advantageously, the design of the front portion 140 of the bottle 120 and the opaque appearance of the remainder of the bottle 120 allows the front portion 140 to be relatively small and only surround a portion of the barrel 150 (e.g., 90 degrees, 180 degrees, 270 degrees, etc.). Further, by designing the rotating barrel 150 to include a window so as to only partially surround the figurine, the user can more clearly see the figurine since they are only looking through the two walls of the front portion 140 when the window of the barrel 150 is aligned with the front portion 140.

Figure 1C:
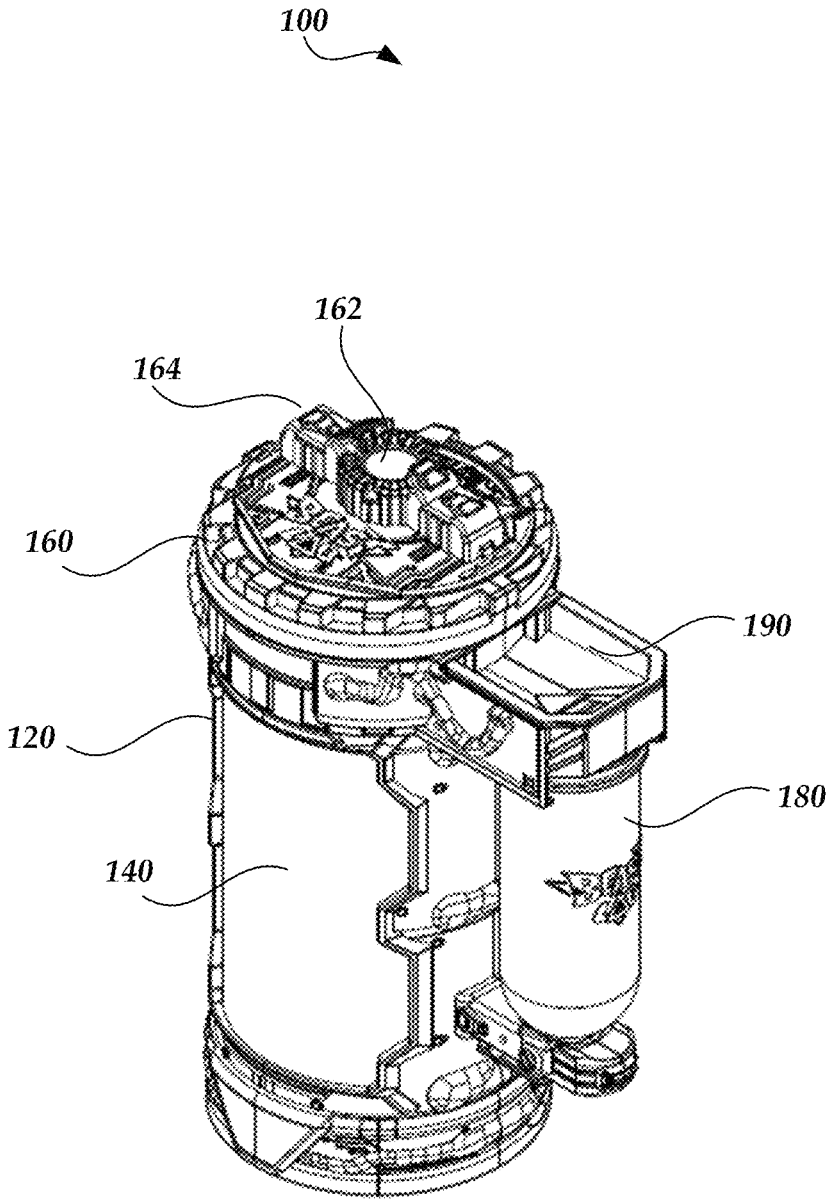
FIG. 1C is a top, front, perspective view of the toy system of FIG. 1A in accordance with some embodiments of the present disclosure.

FIG. 1C is a perspective view of the toy system 100 of FIG. 1A in accordance with some embodiments of the present disclosure. In some embodiments, the toy system 100 includes the bottle 120, the barrel 150, the bottle lid 160, the tube 180, and the figurine (not shown in FIG. 1C) that can be contained within the barrel 150. The bottle 120 may include at least the front portion 140 and the first portion 190. The bottle lid 160 may include a lock 162 and a handle 164.

In some embodiments, the front portion 140 may be an inner space within the bottle 120. For example, the front portion 140 may be a dye container or a tank that can receive and store liquid (not shown in FIG. 1C). The front portion 140 may be formed mainly by two walls (e.g., concentric walls with a gap therebetween and closed about their outer periphery). The gap between the two walls of the front portion 140 may be, for example, 0.5 millimeter (mm), 1.0 mm, 1.5 mm, 2.0 mm, 2.5 mm, 3.0 mm, 3.5 mm, 4.0 mm, 5.0 mm, 5.5 mm, 6.0 mm, 6.5 mm, 7.0 mm, 7.5 mm, 8.0 mm, 8.5 mm, 9.0 mm, 9.5 mm, 10.0 mm, or any range of values therebetween. In some embodiments, the front portion 140 may cover less than 50% of the entire outer surface (e.g., surface of the bottle 120 that is exposed to a user's view from outside the bottle 120) area of the bottle 120.

In some embodiments, the front portion 140 may appear transparent to a user such that the user may view into the bottle 120 through the front portion 140. More specifically, the material used to form the front portion 140 may include any transparent and/or translucent material, such as acrylic, plastic, glass or the like. The remaining portions of the bottle 120 (e.g., the bottle lid 160) may be non-transparent or opaque. As such, the user may not see inside the bottle 120 to view content within the bottle 120 (e.g., the rotating barrel 150 and its contents) through the remaining portions of the bottle 120. The remaining portion of the bottle 120 may be formed by a color coated or non-transparent material (e.g., metal, plastic, or the like).

In some embodiments, although not illustrated in FIG. 1C, the tube 180 may contain fluid (e.g., liquid). The tube 180 may be detachably connected to the toy system 100. The user may remove the tube 180 from the toy system 100, and pour liquid inside the tube 180 into the first portion 190 of the bottle 120. The liquid may flow from the first portion 190 into the front portion 140. The liquid may be initially opaque or dark in color. As such, after the liquid flows into and fills the front portion 140, the user may not view the content (e.g., the rotating barrel 150 and/or the figurine) housed inside the bottle 120 through the front portion 140.

Figure 2:
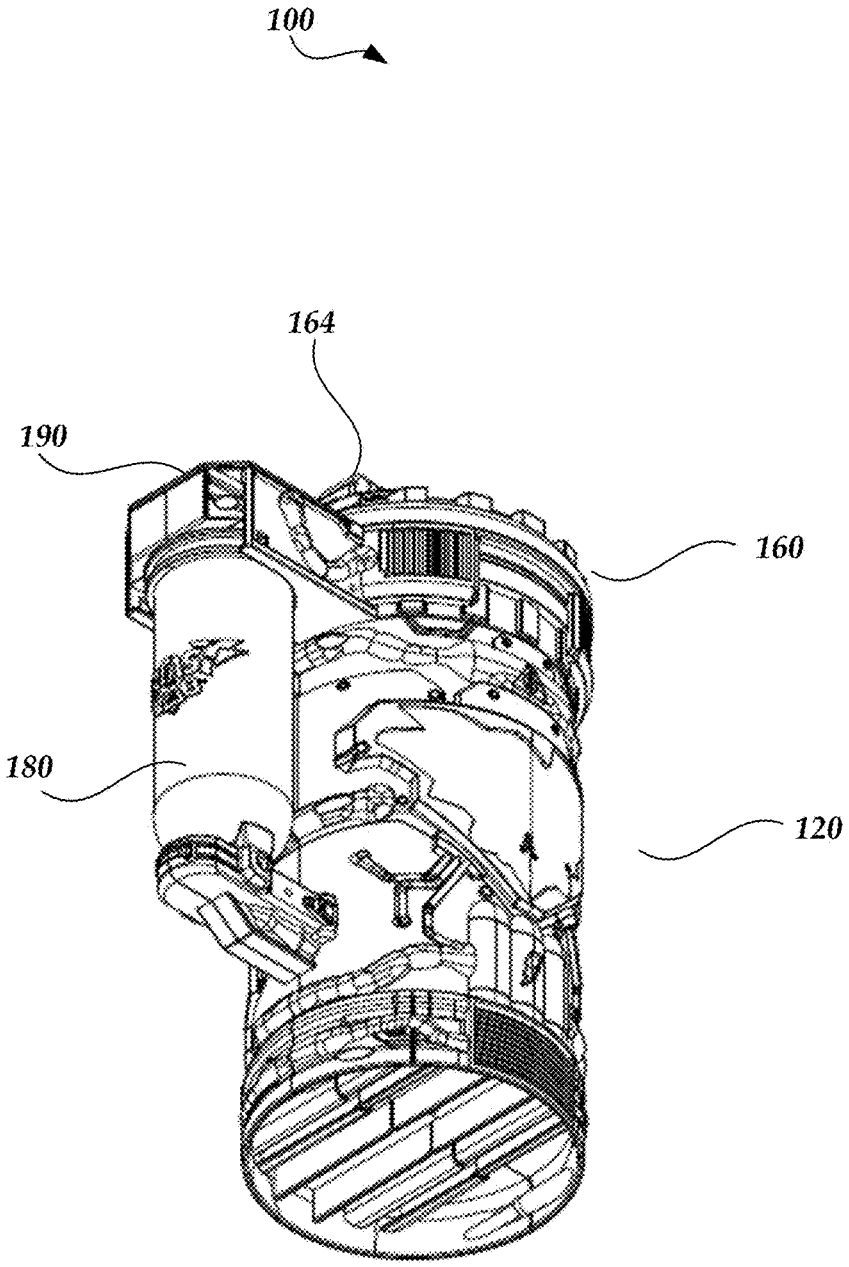
FIG. 2 is a bottom, side perspective view of the toy system of FIG. 1A in accordance with some embodiments of the present disclosure.
Figure 3:
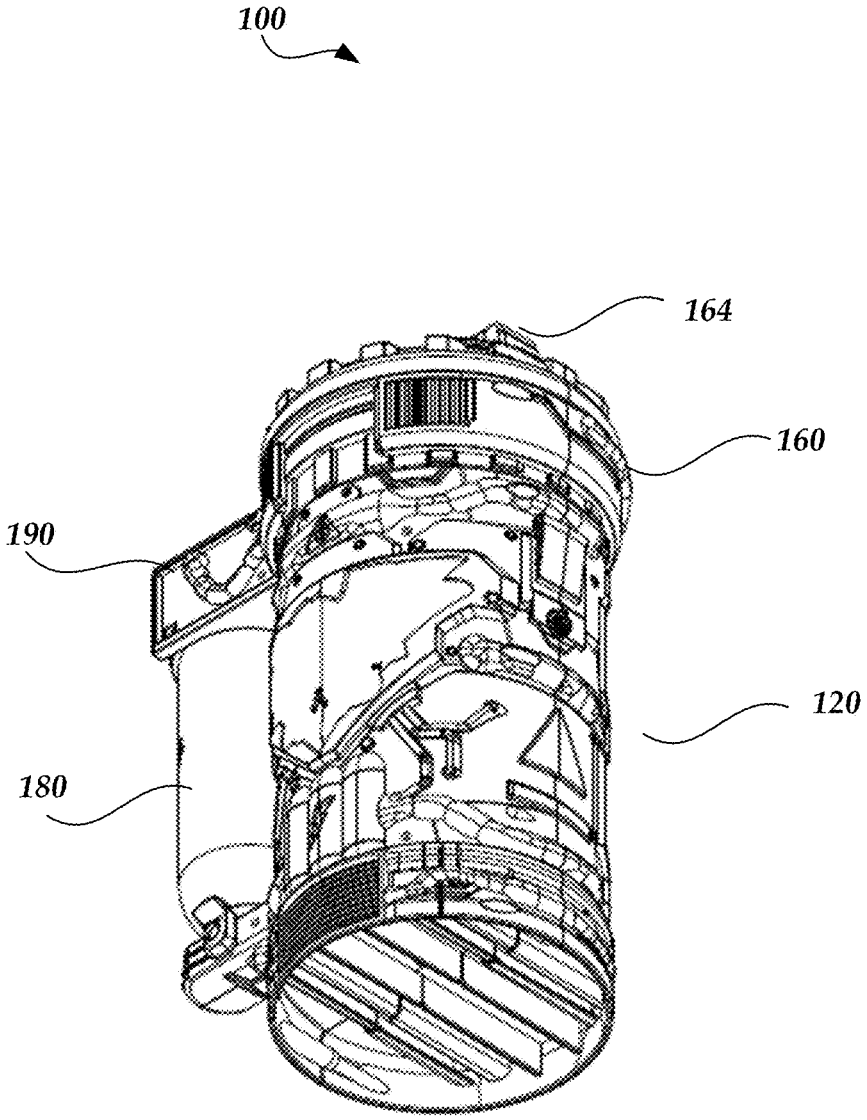
FIG. 3 is a bottom, back perspective view of the toy system of FIG. 1A in accordance with some embodiments of the present disclosure.

FIGS. 2 and 3 are perspective views of the toy system 100 of FIG. 1A in accordance with some embodiments of the present disclosure. As illustrated, the toy system 100 includes the bottle 120 and the tube 180. The bottle 120 includes at least the first portion 190. The bottle lid 160 includes the handle 164.

Figure 4:
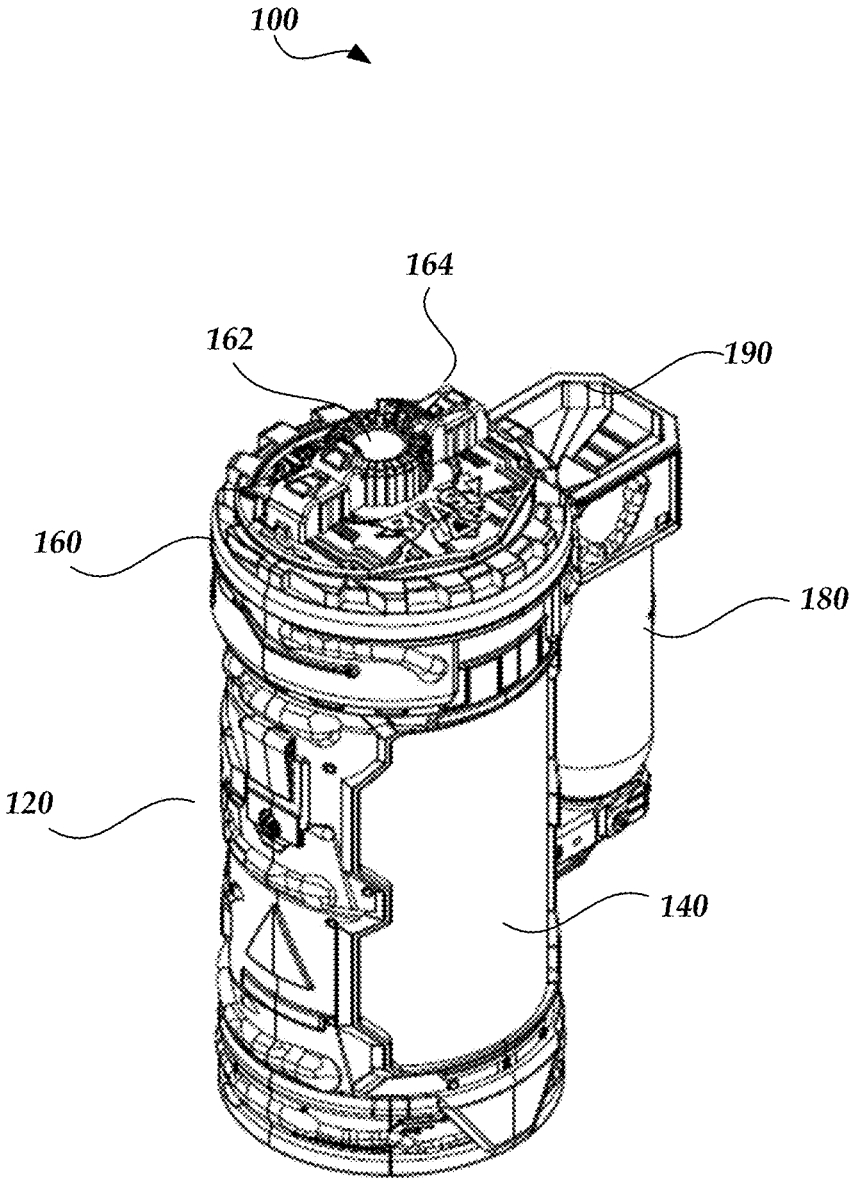
FIG. 4 is a top, side perspective view of the toy system of FIG. 1A in accordance with some embodiments of the present disclosure.
Figure 5:
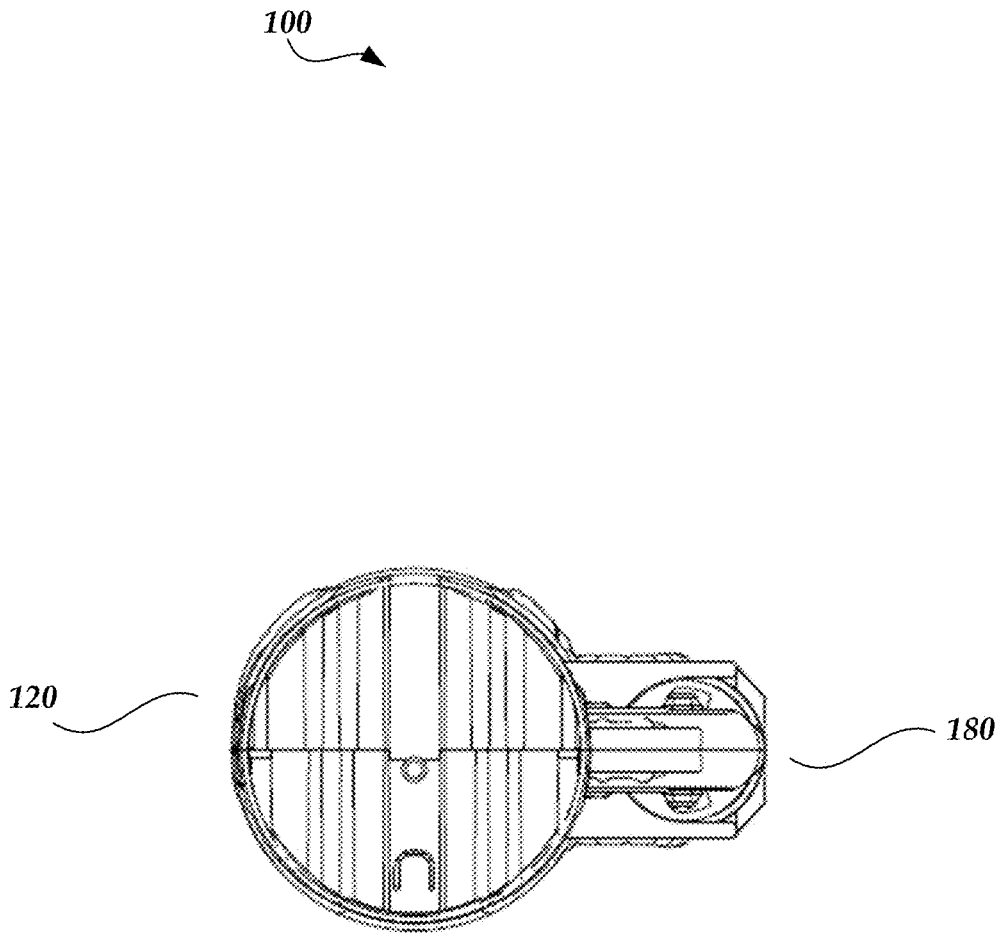
FIG. 5 is a bottom view of the toy system of FIG. 1A in accordance with some embodiments of the present disclosure.

FIGS. 4 and 5 are perspective views of the toy system 100 of FIG. 1A in accordance with some embodiments of the present disclosure. As illustrated, the toy system 100 includes the bottle 120 and the tube 180. The bottle 120 includes at least the first portion 190. The bottle lid 160 includes the lock 162 and the handle 164.

Figure 6:
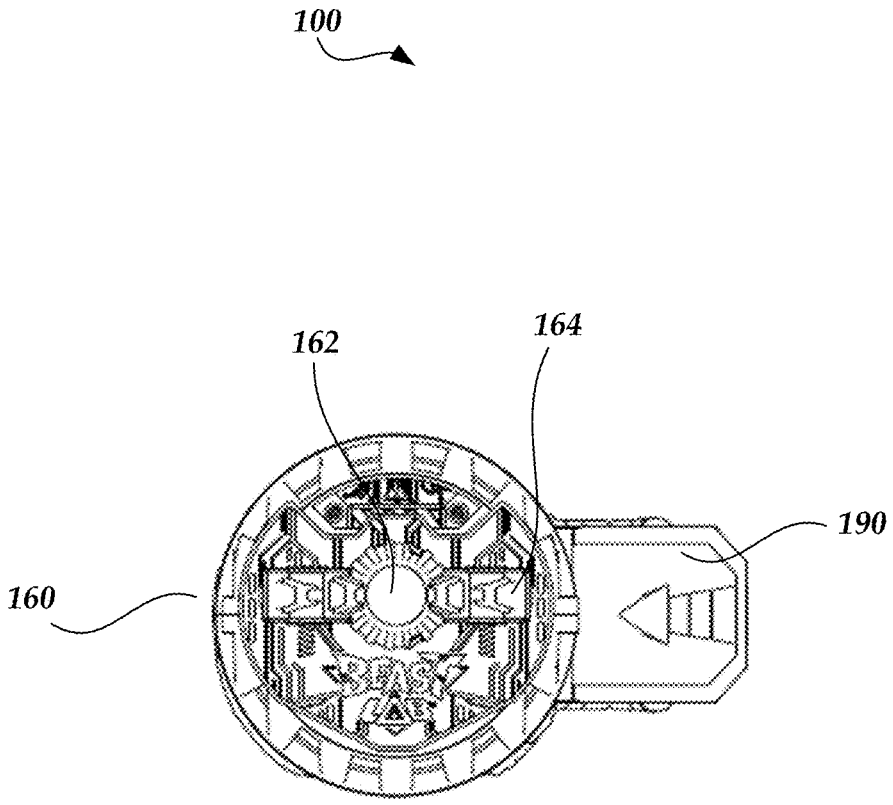
FIG. 6 is a top view of the toy system of FIG. 1A in accordance with some embodiments of the present disclosure.
Figure 7:
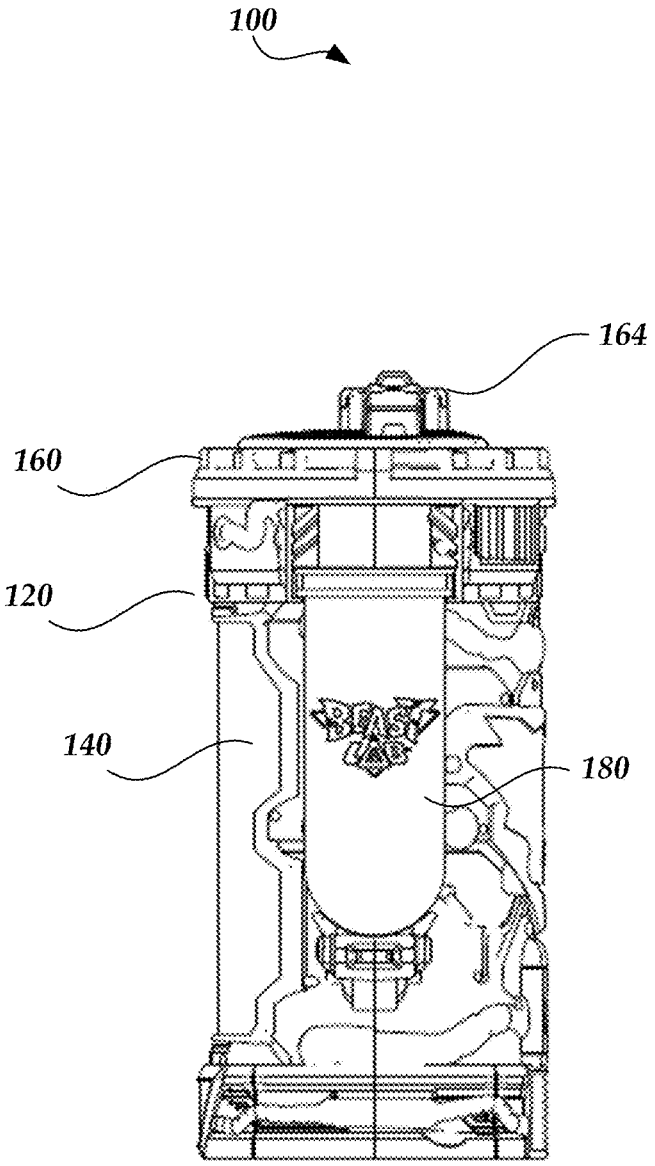
FIG. 7 is a side view of the toy system of FIG. 1A in accordance with some embodiments of the present disclosure.

FIG. 6 is a top view of the toy system 100 of FIG. 1A in accordance with some embodiments of the present disclosure. FIG. 7 is a side view of the toy system 100 of FIG. 1A in accordance with some embodiments of the present disclosure. As illustrated, the toy system 100 includes the bottle lid 160 and the first portion 190. The bottle lid 160 includes the lock 162 and the handle 164.

Figure 8:
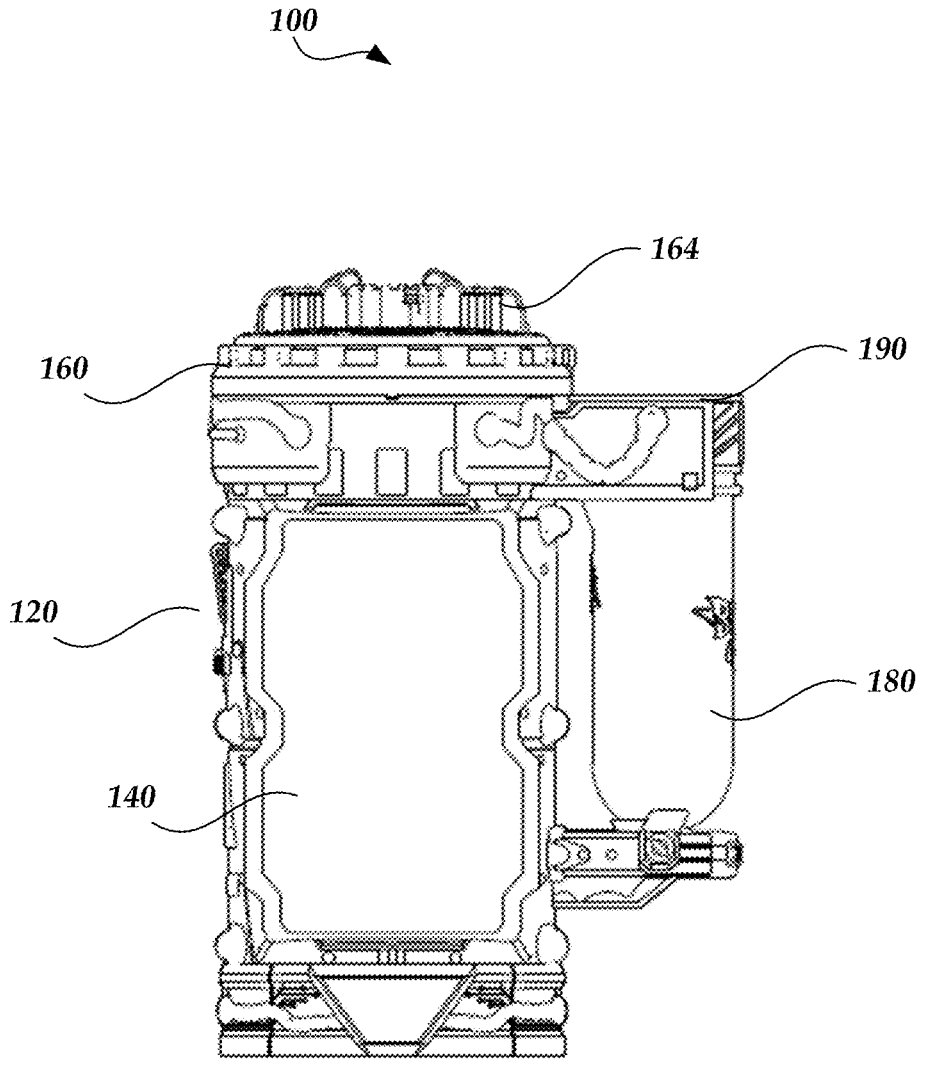
FIG. 8 is front view of the toy system of FIG. 1A in accordance with some embodiments of the present disclosure.

FIG. 8 is another side view of the toy system 100 of FIG. 1A in accordance with some embodiments of the present disclosure. As illustrated in FIG. 8, the toy system 100 includes the bottle 120 and the tube 180. The bottle 120 includes the first portion 190 and the front portion 140. The bottle lid 160 includes the handle 164.

Figure 9:
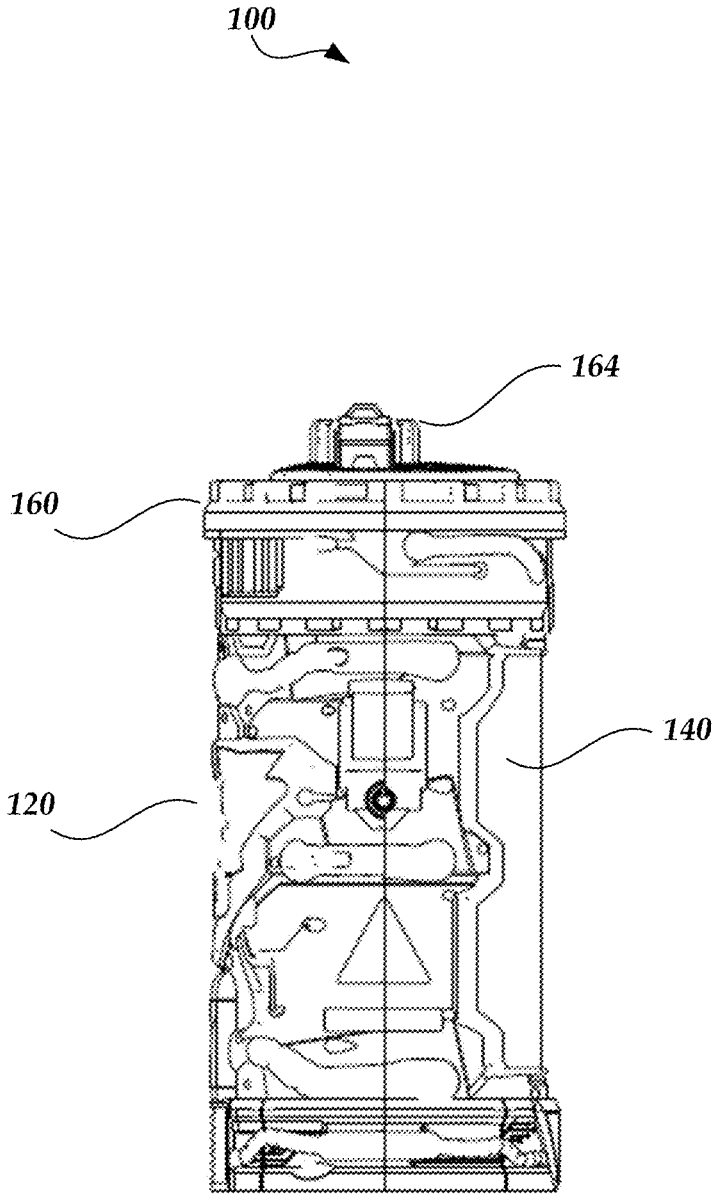
FIG. 9 is another side view of the toy system of FIG. 1A in accordance with some embodiments of the present disclosure.

FIG. 9 is another side view of the toy system 100 of FIG. 1A in accordance with some embodiments of the present disclosure. As illustrated in FIG. 9, the toy system 100 includes the bottle 120. The bottle 120 includes at least the front portion 140. The bottle lid 160 includes the handle 164.

Figure 10:
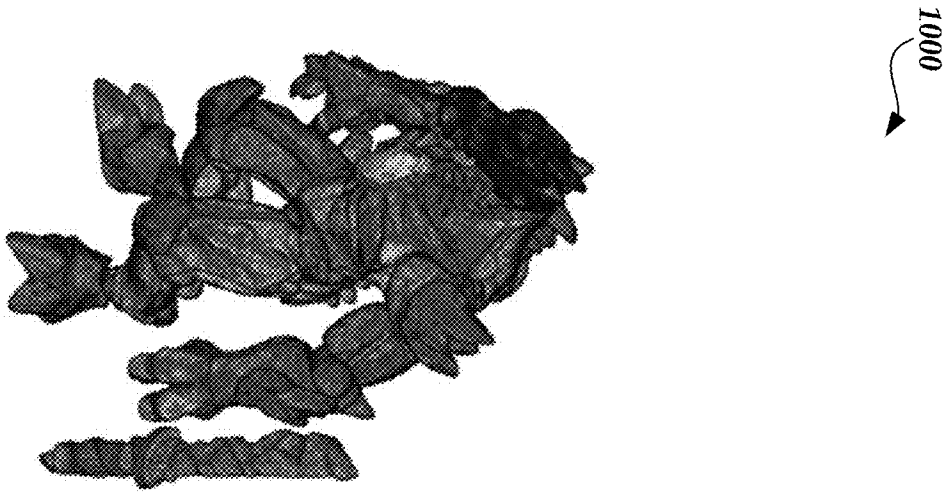
FIG. 10 is a perspective view of a figurine of the toy system of FIG. 1A in accordance with some embodiments of the present disclosure.

FIG. 10 is a perspective view of a figurine 1000 of the toy system 100 of FIG. 1A in accordance with some embodiments of the present disclosure. As noted above, the figurine 1000 may be contained within the rotating barrel 150 of the toy system 100. As illustrated in FIG. 10, the figurine 1000 can have the shape of a beast. It should be noted that, the figurine 1000 can be any other toy (e.g., a doll, a stuffed toy, a plush toy, or the like) and may take any other form (e.g., a miniature animal, a creature, or the like).

Figure 11:
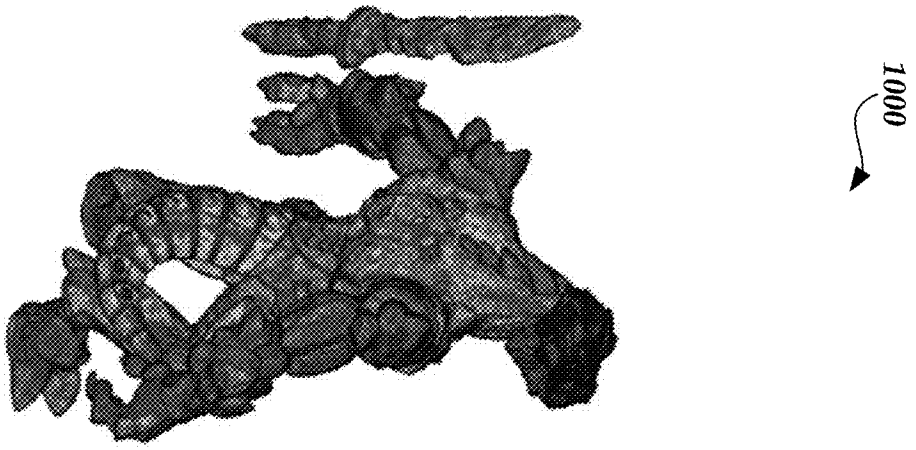
FIG. 11 is another perspective view of the figurine of FIG. 10 in accordance with some embodiments of the present disclosure.
Figure 12:
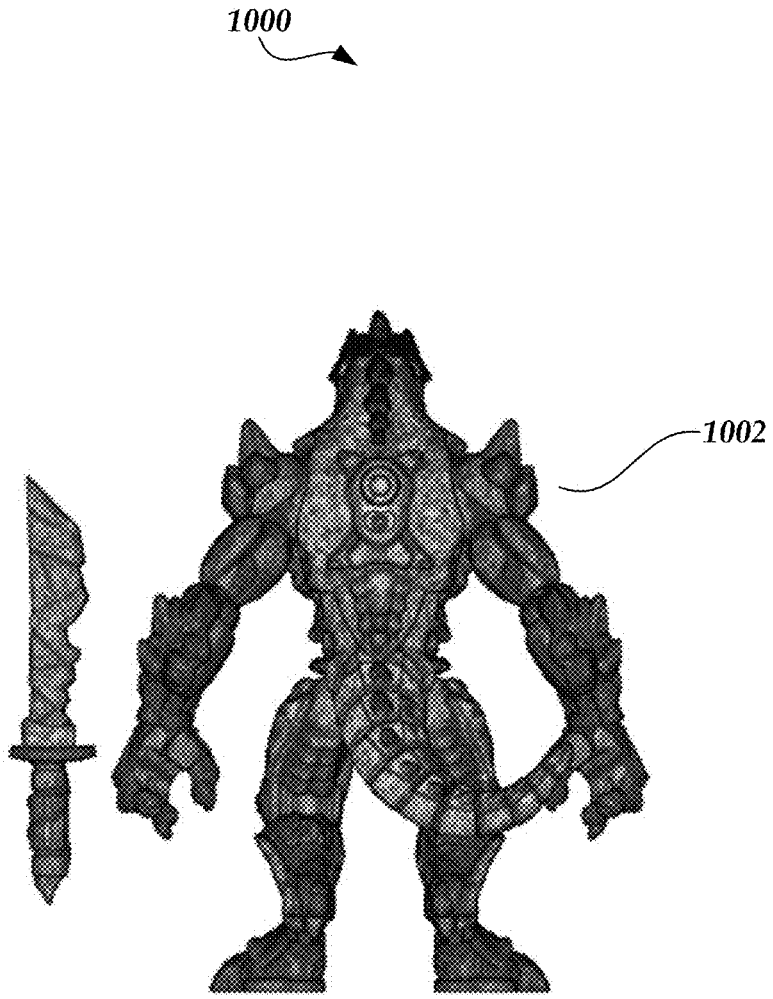
FIG. 12 is a back view of the figurine of FIG. 10 in accordance with some embodiments of the present disclosure.

FIG. 11 is another perspective view of the figurine 1000 of FIG. 10 in accordance with some embodiments of the present disclosure. FIG. 12 is a back view of the figurine 1000 of FIG. 10 in accordance with some embodiments of the present disclosure. FIG. 12 illustrates a back 1002 of the figurine 1000.

Figure 13:
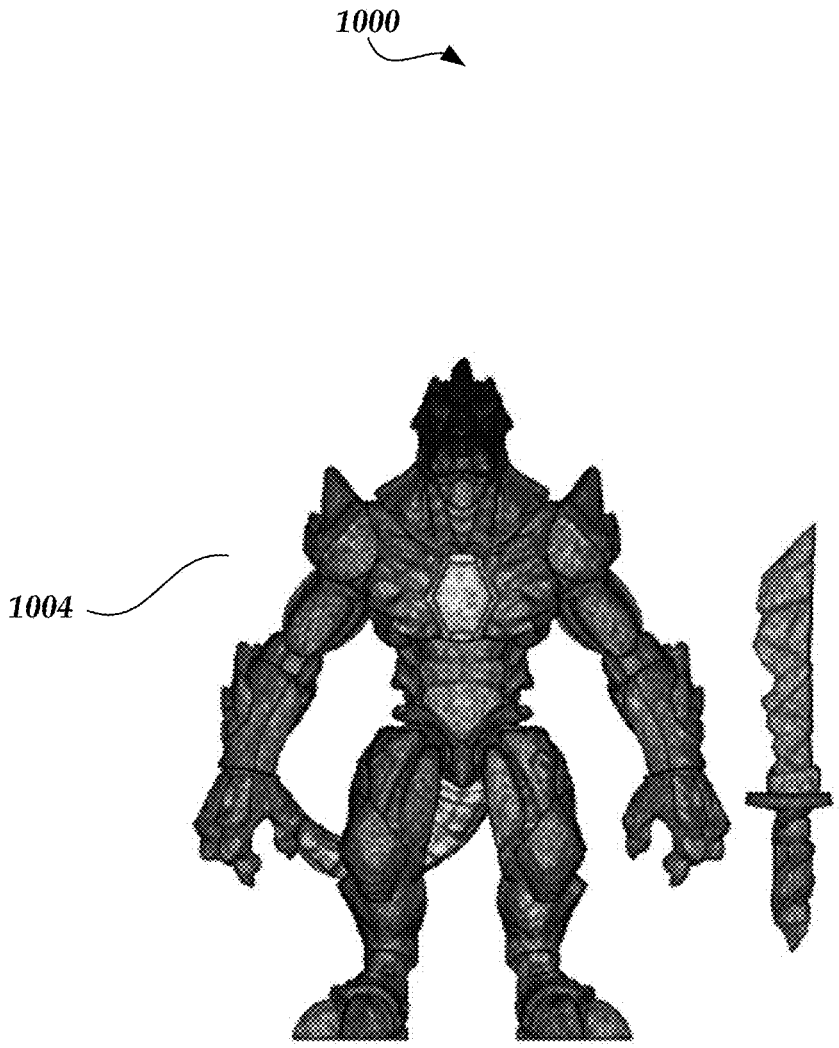
FIG. 13 is a front view of the figurine of FIG. 10 in accordance with some embodiments of the present disclosure.
Figure 14:
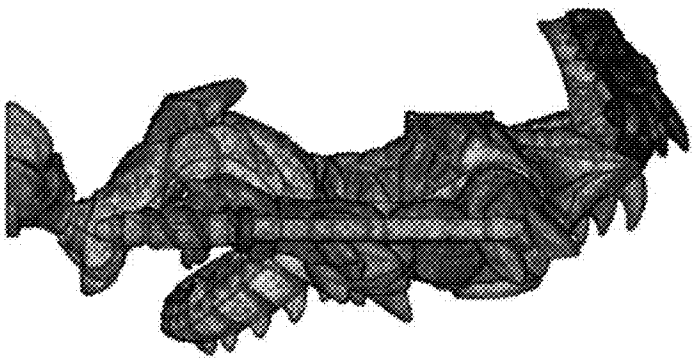
FIG. 14 is a side view of the figurine of FIG. 10 in accordance with some embodiments of the present disclosure.

FIG. 13 is a front view of the figurine 1000 of FIG. 10 in accordance with some embodiments of the present disclosure. FIG. 13 illustrates a front 1004 of the figurine 1000. FIG. 14 is a side view of the figurine 1000 of FIG. 10 in accordance with some embodiments of the present disclosure.

Figure 15:
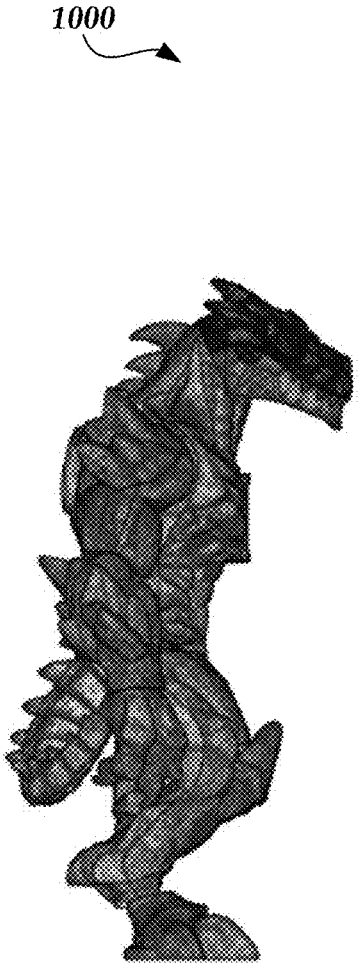
FIG. 15 is another side view of the figurine of FIG. 10 in accordance with some embodiments of the present disclosure.
Figure 16:
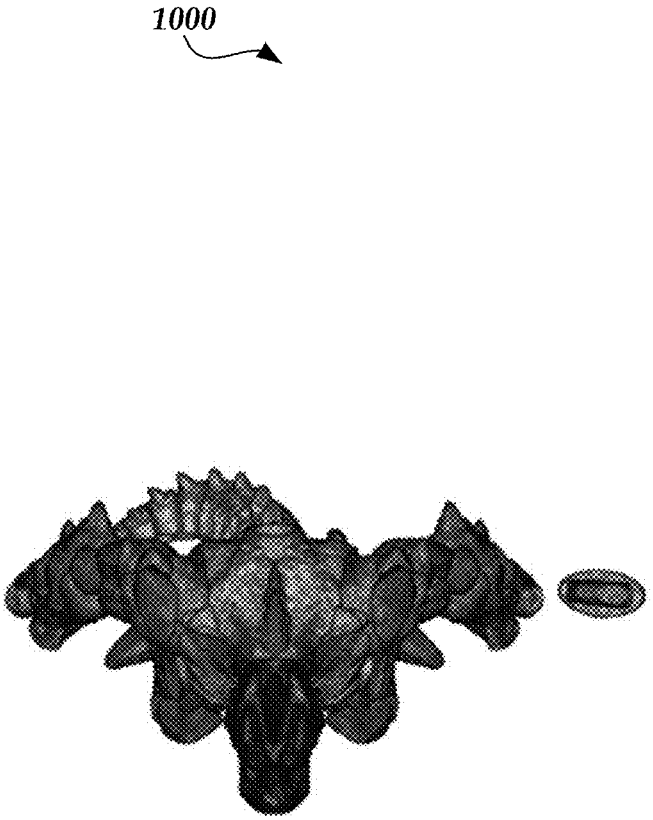
FIG. 16 is a top view of the figurine of FIG. 10 in accordance with some embodiments of the present disclosure.

FIG. 15 is another side view of the figurine 1000 of FIG. 10 in accordance with some embodiments of the present disclosure. FIG. 16 is a top view of the figurine 1000 of FIG. 10 in accordance with some embodiments of the present disclosure.

In some embodiments, before a user interacts with the toy system 100, the figurine 1000 may be rear facing to the front portion 140 of the bottle 120. More specifically, before the user interacts with the toy system 100, the back 1002 of the figurine 1000 may face the front portion 140 of the bottle 120, and the front 1004 of the figurine 1000 may not face the front portion 140 of the bottle 120.

As noted above, in some embodiments, the user may interact with the toy system 100 by removing the tube 180 from the toy system 100 and pour fluid (e.g., liquid) within the tube 180 into the front portion 140 of the bottle 120 through the first portion 190 of the bottle 120. The liquid may be a color changing liquid that changes color when mixed with a clarifying agent from the capsule. Before mixing with the clarifying agent, the liquid may be opaque or dark in color. As such, after pouring the liquid into the front portion 140, the user may not view the rotating barrel 150 inside the bottle 120 through the front portion 140 because the liquid occupies the front portion 140 of the bottle 120.

After the liquid occupies the front portion 140, a user may actuate (e.g., rotate) the handle 164 of the bottle lid 160 to expose a button (not shown in FIGS. 1-16) on the bottle lid 160. In some embodiments, prior to rotating the handle 164, the user may push the lock 162 to unlock the handle 164, thereby configuring the handle 164 to be rotatable against the bottle lid 160.

As noted above, the figurine 1000 can be contained in the rotating barrel 150. The rotating barrel 150 may be contained within the bottle 120 of the toy system 100. A top portion of the rotating barrel 150 may be connected to a bottom portion of the bottle lid 160. As such, when a user rotates the handle 164 of the bottle lid 160, the rotating barrel 150 may be rotated as well, thereby causing the figurine 1000 within the rotating barrel 150 to change from rear facing (e.g., the back 1002 of the figurine 1000 faces the front portion 140) to front facing (e.g., the front 1004 of the figurine 1000 faces the front portion 140) the front portion 140 of the bottle 120, and causing the figurine 1000 not to be blocked by an opaque portion of the rotating barrel 150. However, because of the presence of the liquid that has not been mixed with a clarifying agent, the user may not identify the identity of the figurine 1000 even though the front 1004 of the figurine 1000 may be facing the front portion 140 of the bottle 120 and the figurine 1000 is not blocked by the opaque portion of the rotating barrel 150 from view.

To reveal an identity of the figurine 1000, the user may interact with (e.g., press) the button that is exposed to view after rotating the handle 164 to release a clarifying agent from the capsule into the front portion 140 of the bottle 120. The clarifying agent may cause the liquid inside the front portion 140 to change within a particular amount of time from an opaque or a dark color to a color (e.g., a transparent color) that permits the user to look through the front portion 140 into the bottle 120 to identify the figurine 1000. The capsule can be disposed in the bottle 120 and above the barrel 150. Pressing of the handle 164 or button can cause spikes to puncture the capsule. The ingredient changes a transparency of the liquid. In certain embodiments, the ingredient is configured to create fizz in the liquid. After the liquid changes to the color or becomes transparent, the user may see the front 1004 of the figurine 1000 and identify the identity of the figurine 1000 as a beast.

After the identity of the figurine 1000 is revealed, the user may manipulate (e.g., unscrew or rotate) the bottle lid 160 to remove the bottle lid 160 from the bottle 120. After removing the bottle lid 160 from the bottle 120, the user may retrieve the figurine 1000 from the bottle 120. As noted above, the figurine 1000 may be contained in the rotating barrel 150 and the rotating barrel 150 may be contained within the bottle 120 of the toy system 100. The user may retrieve the figurine 1000 from the rotating barrel 150 after retrieving the rotating barrel 150 from the bottle 120.

FIGS. 17, 18, 19, 20, 21, 22, 23, 24, 25, 26, 27 and 28 illustrate an example process for a user to interact with a toy system, such as the toy system 100 of FIG. 1A, in accordance with some embodiments of the present disclosure. As will be described below, the example process includes steps 1702, 1704, 1706, 1708, 1710, 1712, 1714, 1716, 1718, 1720, 1722, and 1724. It should be noted that some step(s) of the example process may be performed simultaneously and/or in various orders. Further, additional interactions between a user and the toy system 100 not illustrated in the example process may occur.

Figure 17:
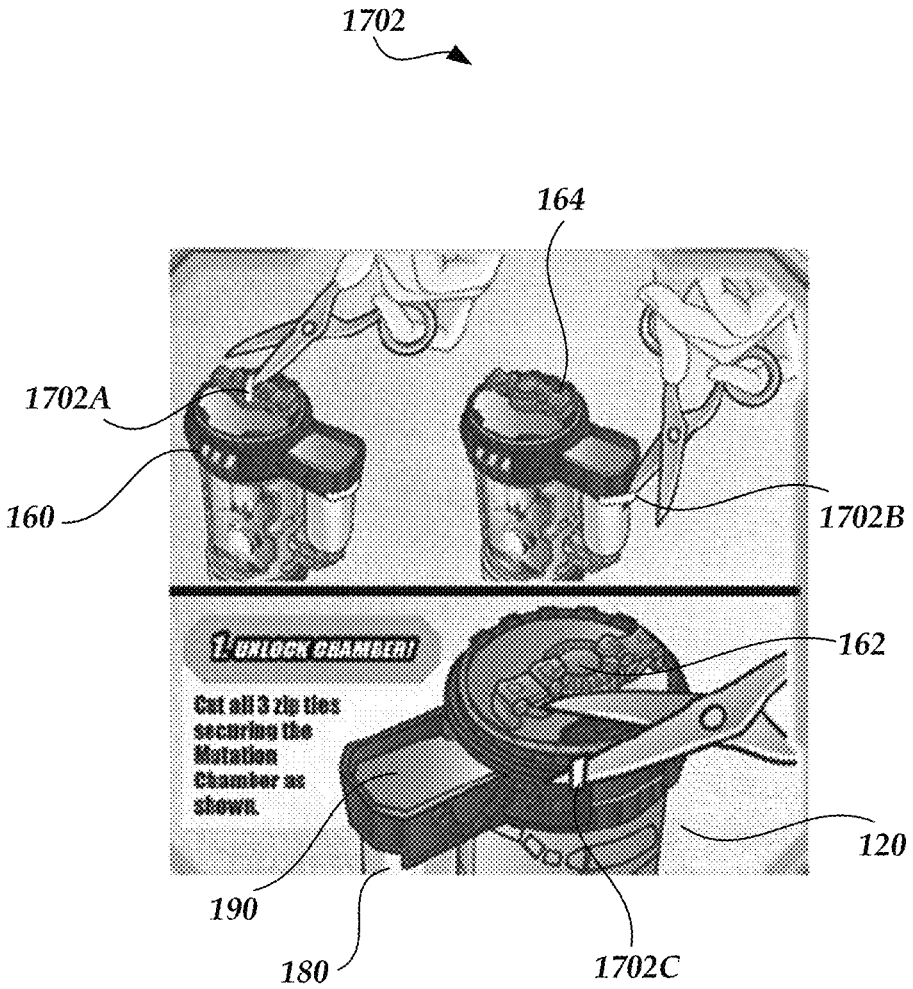
FIGS. 17, 18, 19, 20, 21, 22, 23, 24, 25, 26, 27 and 28 illustrate an example process for a user to interact with a toy system, such as the toy system of FIG. 1A, in accordance with some embodiments of the present disclosure.

As illustrated in FIG. 17, at 1702, a user may remove ties that secure the toy system 100 to enable the user to interact with the toy system 100. For example, as shown in FIG. 17, the user may cut zip ties 1702A, 1702B, and 1702C that secure the handle 164, the tube 180, and the bottle lid 160.

Figure 18:
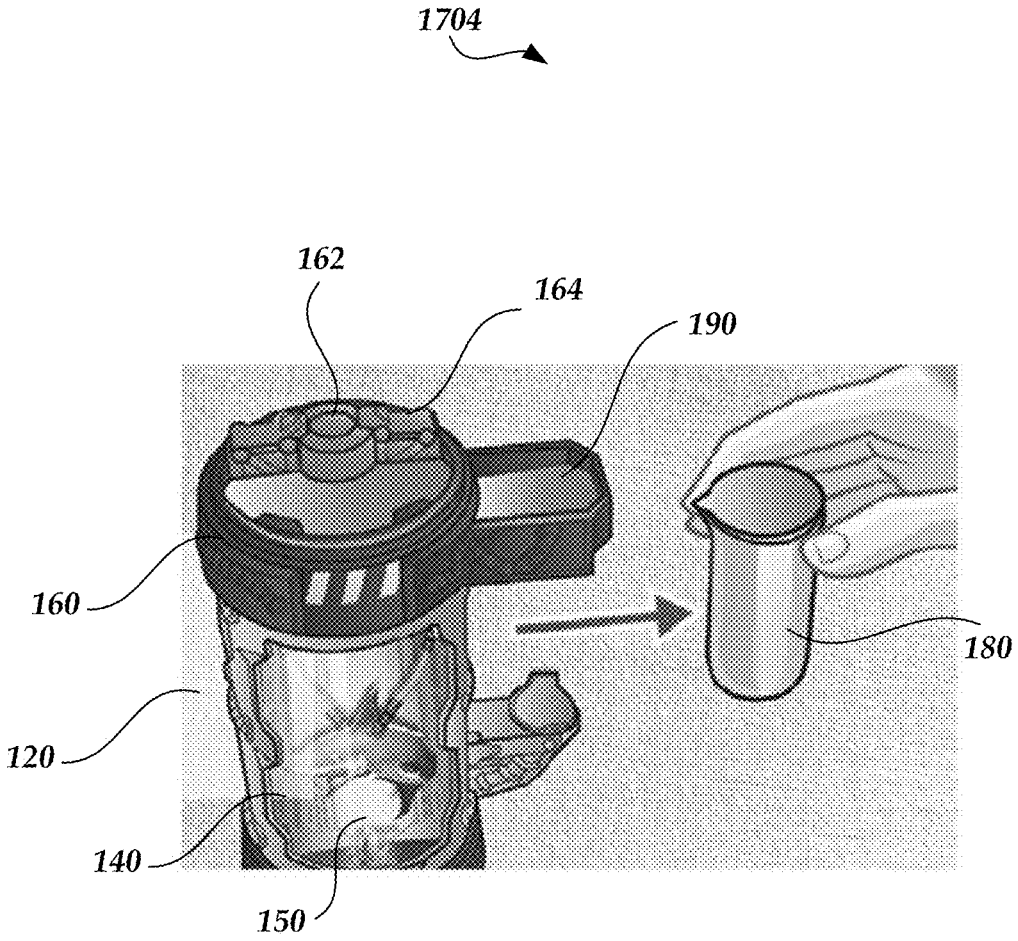

As illustrated in FIG. 18, at 1704, the user may remove the tube 180 from the toy system 100. As indicated in FIG. 18, the user may see into the bottle 120 through the front portion 140. However, the user may not see the figurine 1000 because a non-transparent portion of the rotating barrel 150 blocks the user's view. As shown in FIG. 18, the non-transparent portion of the rotating barrel 150 includes a graphic that resembles a shark.

Figure 19:
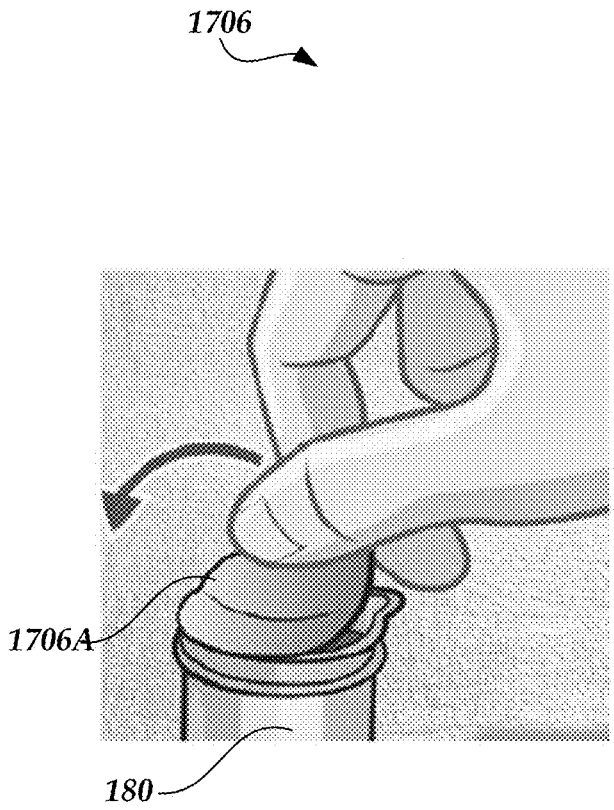

At 1706, as illustrated in FIG. 19, the user may tear away a seal 1706A that seals the tube 180. As such, liquid within the tube 180 may be dispensed.

Figure 20:
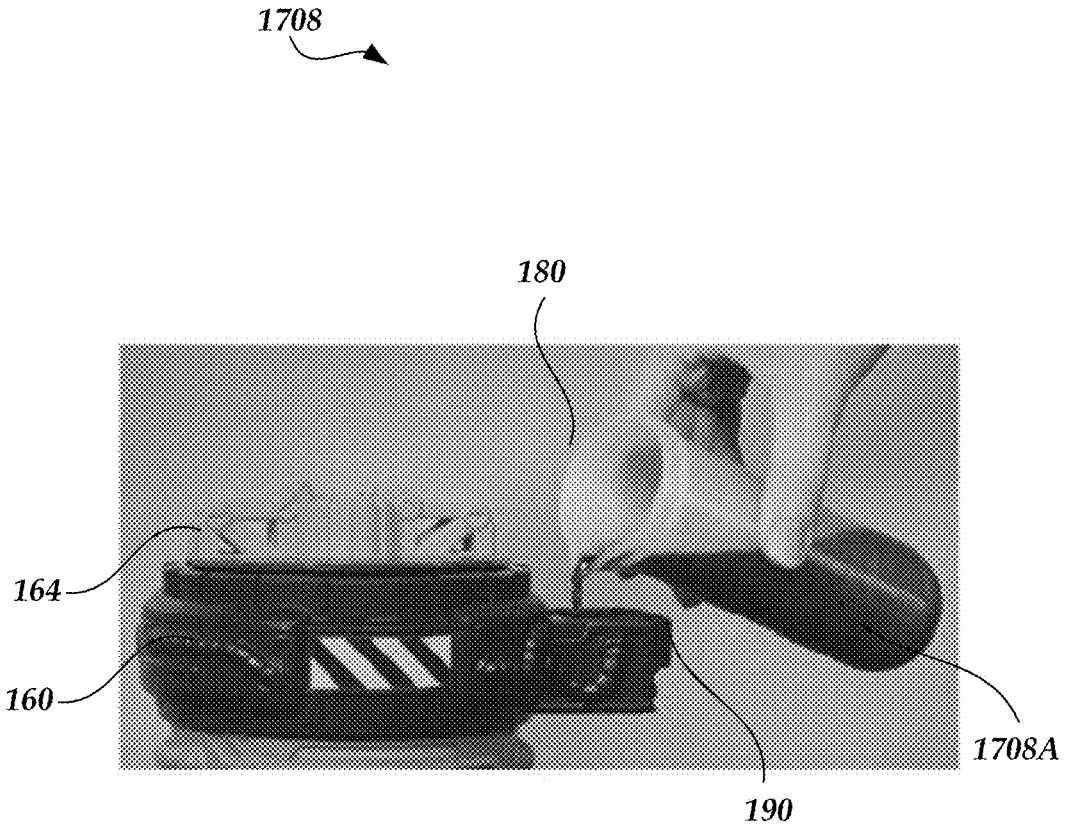

At 1708, as illustrated in FIG. 20, the user may pour the liquid 1708A (e.g., a color-changing liquid) within the tube 180 into the first portion 190. Although not illustrated in FIG. 20, the first portion 190 may be fluidically connected to the front portion 140. As such, the liquid 1708A may flow from the first portion 190 into the front portion 140.

Figure 21:
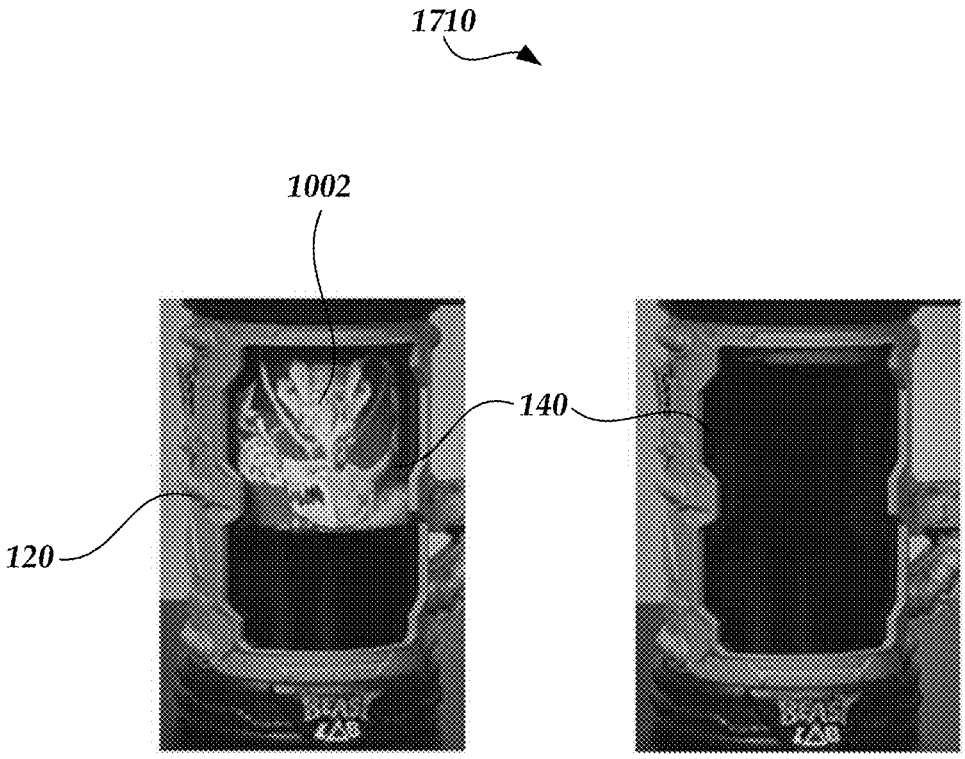

At 1710, as illustrated in FIG. 21, the front portion 140 may be gradually filled by the liquid 1708A as the user pours the liquid 1708A into the first portion 190. As shown in FIG. 21, the liquid 1708A may fill or almost fill the front portion 140 so as to block the user's view into the bottle 120 through the front portion 140.

Figure 22:
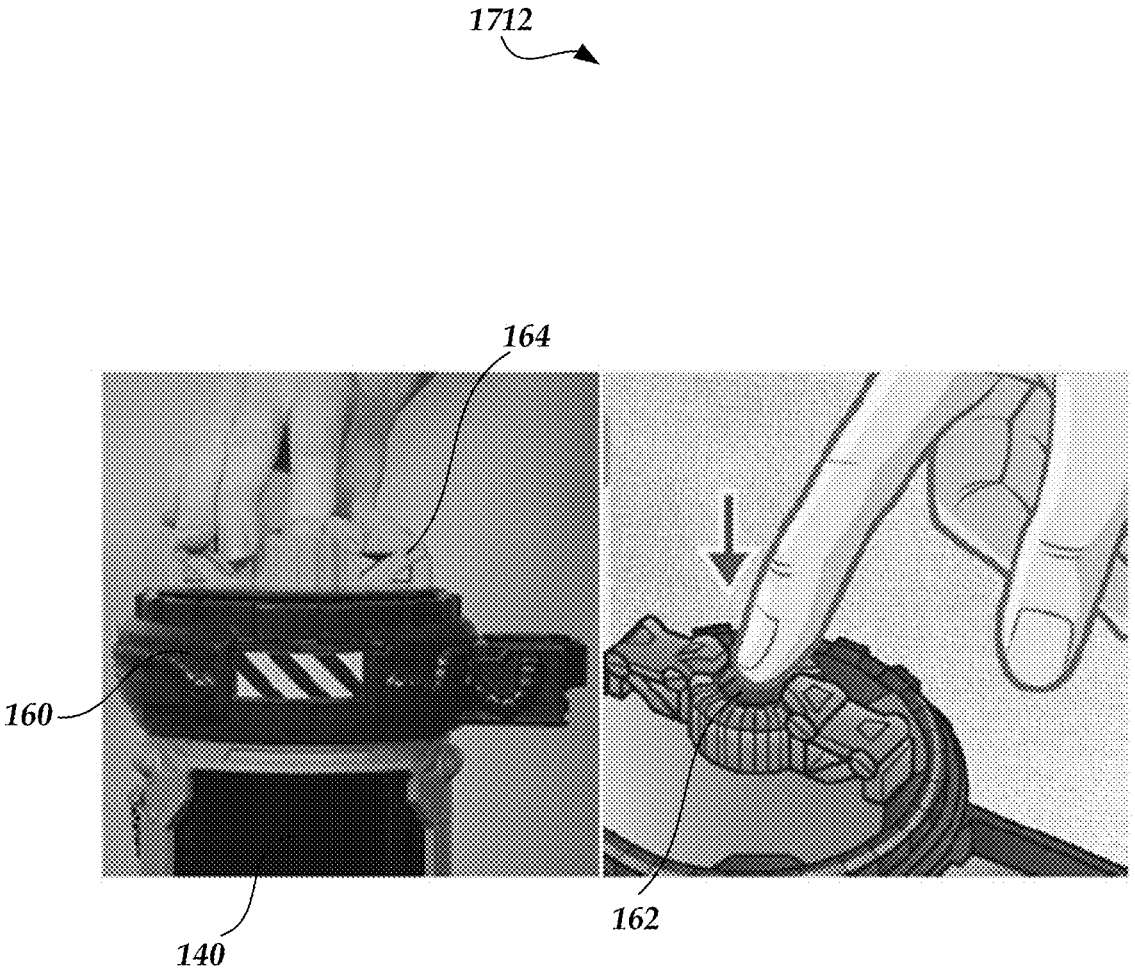

At 1712, as illustrated in FIG. 22, the user may push or press the lock 162. By pushing the lock 162, the user may unlock the lock 162 and the handle 164 to perform further operation(s) on the handle 164.

Figure 23:
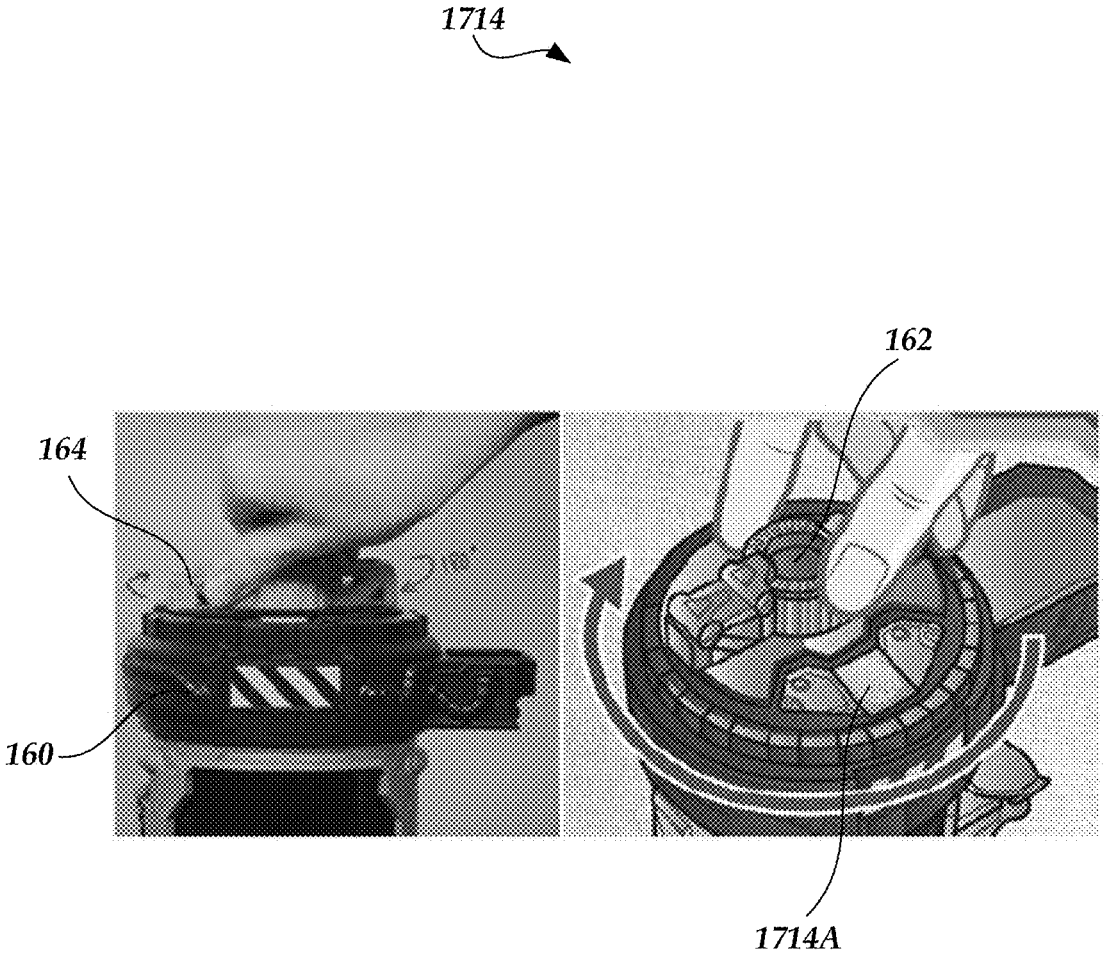

At 1714, as illustrated in FIG. 23, the user may rotate the handle 164 to expose a button 1714A on the bottle lid 160 for dispensing a clarifying agent into the front portion 140. Although not illustrated in FIG. 23, besides exposing the button 1714A, rotating the handle 164 rotates the barrel 150 and the figurine 1000 relative to the bottle 120. For example, as the user rotates the handle 164 by a particular degree (e.g., 180°), the figurine 1000 switches from its rear side facing the front portion 140 of the bottle 120 to its front side facing the front portion 140 of the bottle 120. More specifically, the front 1004 of the figurine 1000 may face the front portion 140 of the bottle 120 after the user rotates the handle 164. Because of the presence of the opaque liquid, the user is unable to see the figurine even though the front 1004 of the figurine 1000 faces the front portion 140 of the bottle 120 and the figurine 1000 is not blocked by a non-transparent portion of the rotating barrel 150.

Figure 24:
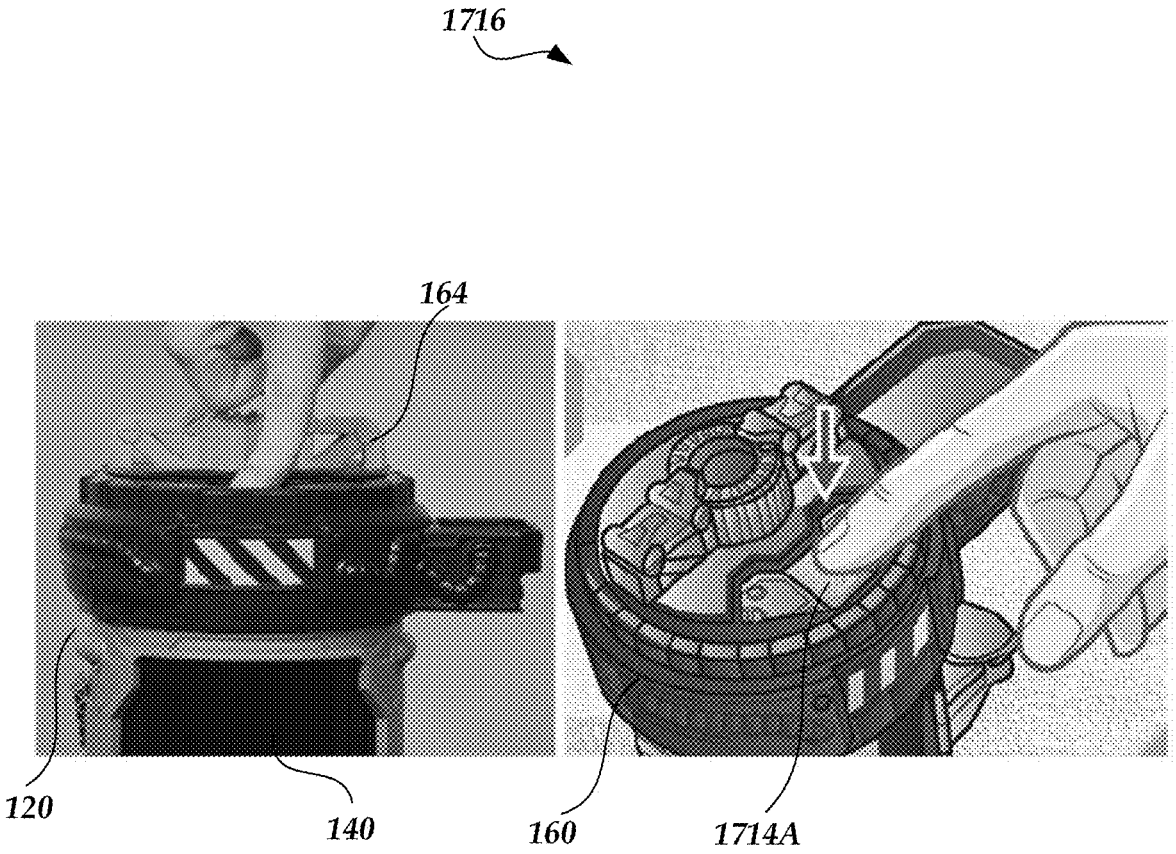

As illustrated in FIG. 24, at 1716, the user may press the button 1714A of the bottle lid 160 to release a clarifying agent into the front portion 140 of the bottle 120. The clarifying agent may cause the liquid inside the front portion 140 to change within a particular amount of time from an opaque or a dark color to a color (e.g., transparent) that permits the user to look through the front portion 140 into the bottle 120.

Figure 25:
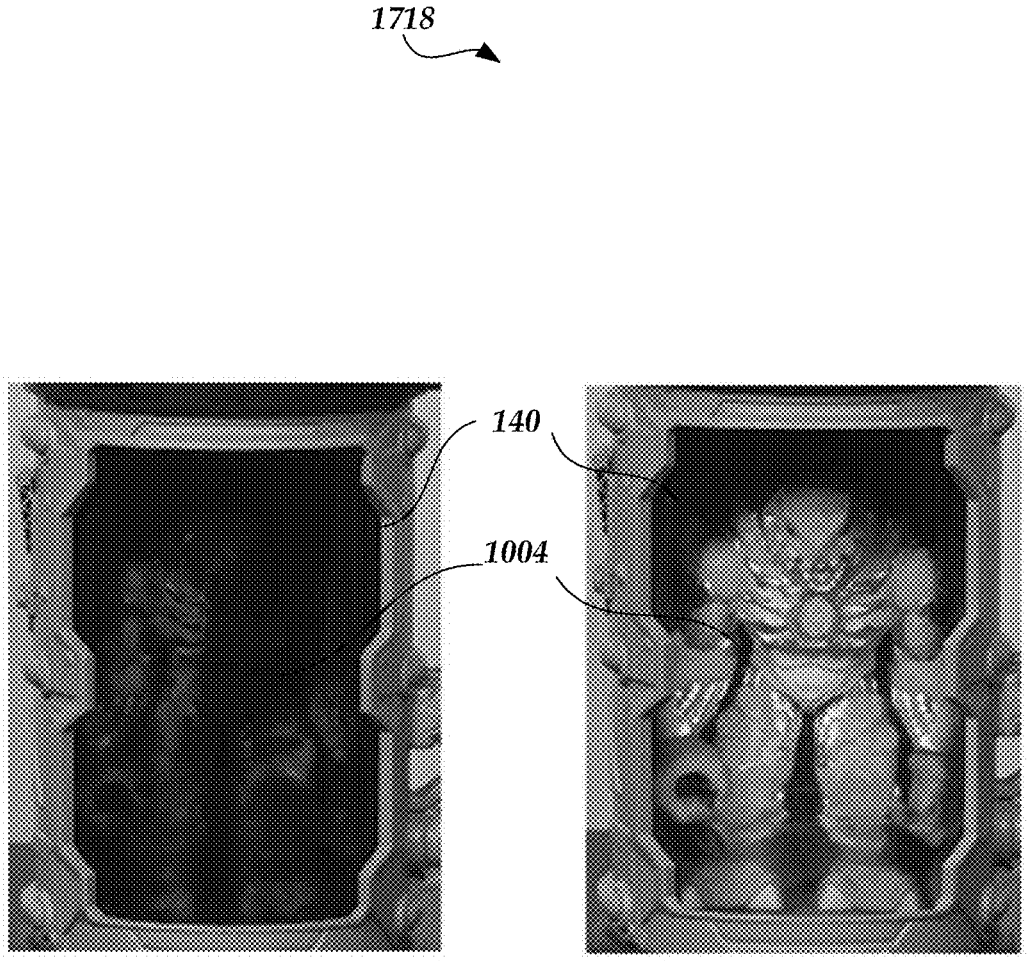

At 1718, as illustrated in FIG. 25, the liquid 1708A may gradually change color to become more transparent to the user as or after the clarifying agent is released into the front portion 140. As the liquid 1708A occupying the front portion 140 becomes more transparent, the front portion 140 becomes more transparent to the user, thereby gradually allowing the user to identify the figurine 1000 by viewing the front 1004 of the figurine 1000.

Figure 26:
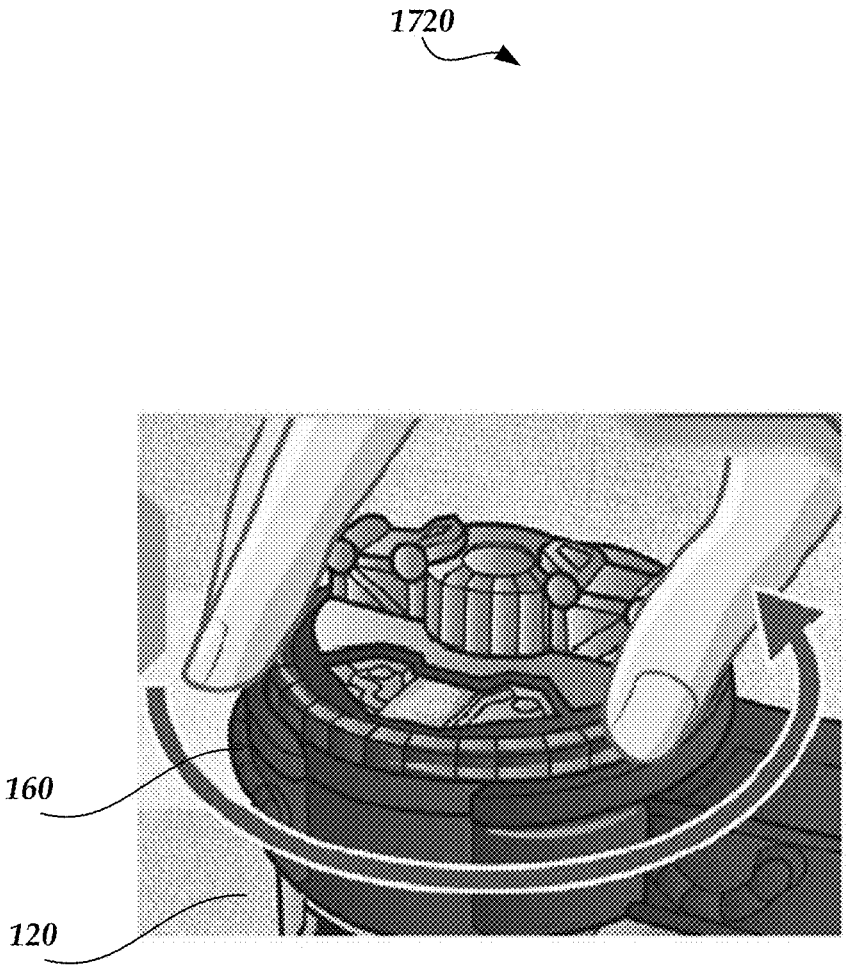

At 1720, as illustrated in FIG. 26, the user may unscrew or rotate the bottle lid 160 to remove the bottle lid 160 from the bottle 120, thereby allowing the user to retrieve the figurine 1000.

Figure 27:
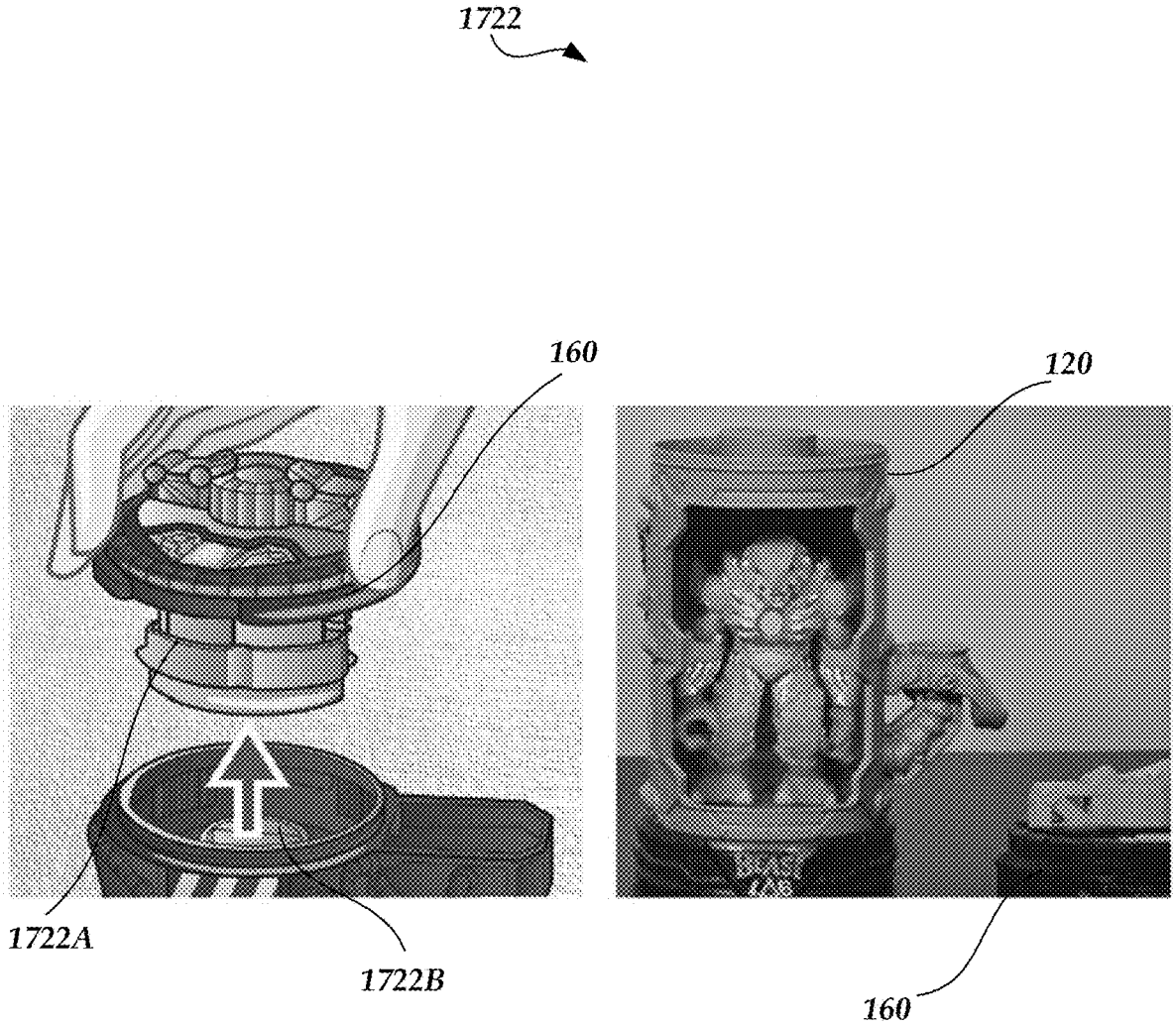

At 1722, as illustrated in FIG. 27, the user may remove the bottle lid 160 from the bottle 120. As shown in FIG. 27, the bottle lid 160 may include a bottom portion 1722A. The bottom portion 1722A of the bottle lid 160 may be connected to a top portion 1722B of the rotating barrel 150 before the bottle lid 160 is removed from the bottle 120. The rotating barrel 150 may fully or partially enclose the figurine 1000.

As such, when the user rotates the handle 164 of the bottle lid 160 as illustrated in FIG. 23, the rotating barrel 150 may be rotated as well, thereby causing the figurine 1000 within the rotating barrel 150 to change from rear facing (e.g., the back 1002 of the figurine 1000 faces the front portion 140) to front facing (e.g., the front 1004 of the figurine 1000 faces the front portion 140) the front portion 140 of the bottle 120 and causing the figurine 1000 to not be blocked by the non-transparent portion of the rotating barrel 150 from view.

Figure 28:
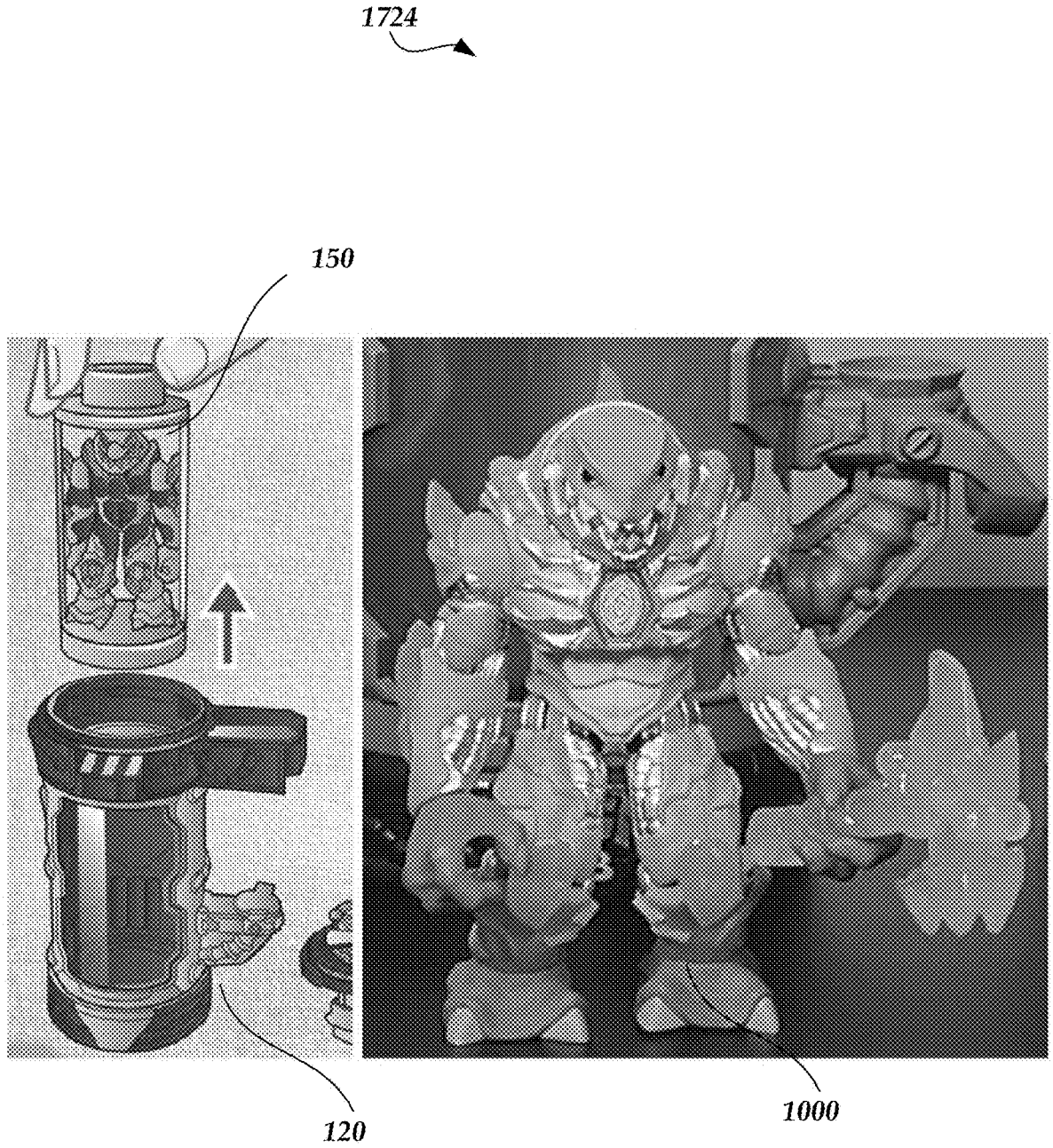

At 1724, as illustrated in FIG. 28, the user may remove the rotating barrel 150 that contains the figurine 1000 from the bottle 120. The user may further remove the figurine 1000 from the rotating barrel 150 to play with the figurine 1000.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The process, flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. In addition, certain blocks may be omitted in some implementations. The methods and processes described herein are also not limited to any particular sequence, and the blocks or states relating thereto can be performed in other sequences that are appropriate.

Many variations and modifications may be made to the above-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated above, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

While the above detailed description has shown, described, and pointed out novel features as applied to various embodiments, it may be understood that various omissions, substitutions, and changes in the form and details of the devices or processes illustrated may be made without departing from the spirit of the disclosure. As may be recognized, certain embodiments of the inventions described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A toy system having an internal space for housing a toy, comprising:

a bottle having a front portion forming a chamber, the chamber having two walls that extend for less than 360 degrees about a circumference of the bottle, the chamber being configured to be filled with a liquid; and a barrel forming the internal space, the barrel being rotatably disposed in the bottle so as to rotate from a first position to a second position, the barrel being sized and shaped to at least partially surround the toy in the internal space, wherein when the barrel is in the first position the internal space of the barrel is not visible through the bottle, wherein when the barrel is in the second position the internal space of the barrel is visible through the bottle, and wherein the barrel is not configured to be filled with the liquid.

2. The toy system of claim 1, further comprising a handle configured to allow a user to rotate the barrel.

3. The toy system of claim 1, further comprising the toy disposed in the internal space, the toy being accessible when the barrel is removed from the bottle.

4. The toy system of claim 1, wherein the two walls are concentric.

5. The toy system of claim 1, further comprising a capsule containing an ingredient configured to mix with the liquid.

6. The toy system of claim 5, wherein the capsule is disposed in the bottle and above the barrel.

7. The toy system of claim 5, wherein the ingredient is configured to change a transparency of the liquid.

8. The toy system of claim 5, wherein the ingredient is configured to create fizz in the liquid.

9. The toy system of claim 5, further comprising a lid having a button, wherein activation of the button is configured to release the ingredient into the liquid.

10. A toy system having an internal space for housing a toy, comprising:

a bottle having a front portion forming a chamber, the chamber having two walls that extend for less than 360 degrees about a circumference of the bottle, the chamber being configured to be filled with a liquid; and a barrel forming the internal space, the barrel being disposed in the bottle and having an opaque portion and a window, the barrel being rotatable relative to the bottle from a first position to a second position, wherein the opaque portion of the barrel overlaps the chamber of the bottle when the barrel is in the first position so that a view of the toy in the internal space of the barrel from outside the bottle is obfuscated, wherein the window of the barrel overlaps the chamber of the bottle when the barrel is in the second position so that the toy is visible through the bottle, and wherein the barrel is not configured to be filled with the liquid.

11. The toy system of claim 10, wherein the two walls are concentric.

12. The toy system of claim 10, further comprising a capsule containing an ingredient configured to mix with the liquid.

13. The toy system of claim 12, wherein the ingredient is configured to change a transparency of the liquid.

14. A toy system comprising:

a barrel having an internal space configured to hold a toy;

a bottle having an outer circumference forming an enclosure to house at least a portion of the barrel therein, a portion of the outer circumference comprising a chamber configured to hold a liquid, the chamber having an inner wall and an outer wall offset from the inner wall, the inner wall and the outer wall extending for less than 360 degrees about the outer circumference of the bottle; and a handle configured to rotate the barrel between at least a first position and a second position relative to the bottle, wherein the barrel is not configured to be filled with the liquid.

15. The toy system of claim 14, further comprising a capsule configured to hold an ingredient, wherein actuation of a button releases the ingredient into the chamber.

16. The toys system of claim 15, wherein the ingredient is a clarifying agent configured to change a transparency of the liquid.

17. The toys system of claim 15, wherein the ingredient is configured to create fizz in the liquid.

18. The toy system of claim 15, wherein the inner wall and the outer wall are transparent, and wherein a remainder of the outer circumference of the bottle is opaque.

19. The toy system of claim 18, wherein the barrel comprises an opaque portion and a window portion, and wherein the opaque portion of the barrel overlaps with the inner wall and the outer wall when the barrel is in the first position, and wherein the window portion of the barrel overlaps with the inner wall and the outer wall when the barrel is in the second position.

20. The toy system of claim 14, wherein the liquid is initially opaque.

* * * * *